US005359830A

United States Patent [19]

Olson et al.

[11] Patent Number: 5,359,830

[45] Date of Patent: Nov. 1, 1994

[54] CLIP-TYPE ARTICLE CARRIER PACKAGING MECHANISM

[75] Inventors: Allen L. Olson, Crosby, Minn.; James W. Emerson, Woodstock, Ga.

[73] Assignee: Riverwood International Corporation, Atlanta, Ga.

[21] Appl. No.: 943,756

[22] Filed: Sep. 11, 1992

[51] Int. Cl.[5] ..... B65B 17/02; B65B 21/00; B65B 61/14

[52] U.S. Cl. ..... 53/398; 53/413; 53/48.1; 53/134.1

[58] Field of Search ..... 53/398, 448, 48.1, 48.7, 53/543, 134.1, 449

[56] References Cited

U.S. PATENT DOCUMENTS

| | | | |
|---|---|---|---|
| 3,094,210 | 6/1963 | Van Den Berg | 53/48.1 X |
| 3,137,109 | 6/1964 | Rapata | 53/48.1 X |
| 3,176,442 | 4/1965 | Ganz | 53/48.1 |
| 3,431,826 | 3/1969 | Gentry | 53/48.1 X |
| 3,447,280 | 6/1969 | Cunningham . | |
| 3,653,503 | 4/1972 | Arneson | 71/100 |
| 3,660,961 | 5/1972 | Ganz | 53/398 |
| 3,745,892 | 7/1973 | Ganz | 53/48.1 X |
| 3,766,704 | 10/1973 | Ganz | 53/48.7 |
| 3,908,332 | 9/1975 | Ebbinghaus et al. | 53/48.7 |
| 4,169,343 | 10/1979 | McArdle | 53/398 |
| 4,188,766 | 2/1980 | Culpepper . | |
| 4,501,104 | 2/1985 | Griffin et al. | 53/48.1 X |
| 4,802,324 | 2/1989 | Everson | 53/398 |
| 5,036,644 | 8/1991 | Lashyro et al. | 53/398 |
| 5,088,269 | 2/1992 | Thelen | 53/398 |
| 5,184,448 | 2/1993 | Kazlauskas | 53/398 |

*Primary Examiner*—Horace M. Culver
*Attorney, Agent, or Firm*—Joel D. Skinner; Steve McLary; Anthony Eggink

[57] ABSTRACT

An article clip packaging machine for applying carton members to the article rims of preselected article groups. The machine has a conveyor with an infeed end for receiving preselected article groups. At least two carton member feeding structures are synchronized with the conveyor for placing carton base and carton top members, respectively, on the preselected article groups. A securing assembly attaches the carton base and top members to the rims of the article groups to provide article group carriers.

29 Claims, 23 Drawing Sheets

CLIP-TYPE ARTICLE CARRIER PACKAGING MECHANISM

FIELD OF THE INVENTION

This invention relates to packaging machines and particularly to assemblies for the manufacture of clip-type article group carriers.

BACKGROUND OF THE INVENTION

Various packaging machines and processes have been used and proposed in the art to package preselected article groups. These machines have typically involved the use of various carton structures, including flat carton blanks, carton sleeves and partially constructed carton configurations, which subsequently are filled or wrapped and secured about preselected article groups.

The present invention relates to continuous motion packaging machines to apply carton clip structures to article groups. Particularly, the invention relates to packaging machines to apply various carton clip structures to the tops of article groups to assemble a variety of environmentally friendly packaged units. Carton clip packaging structures provide the benefit of using less packaging material than presently used cartons which fully surround each article group, such as a six pack of canned beverages.

Presently plastic ring structures are being utilized to join or clip articles together to form carriers for retail sale or for subsequent packaging operations. Although such plastic ring structures provide a suitable economic alternative to article groups packaged in carton structures, they have increasingly been found to present environmental problems, particularly relating to waste management and danger to animal life.

Applicants' assignee has developed carton clip-type article carriers which are comprised of carton members and used to assemble article group carriers. These carton clip carriers are disclosed in U.S. patent application Ser. No. 07/899,192, filed on Jun. 16, 1992, entitled, "Clip-Type Article Carrier and Method of Manufacture", which is incorporated by reference herein. The article clip packaging machines of the present invention are designed to apply the carton clip carriers of the '192 application to article groups to form article group carriers.

The packaging machines of the present invention are designed to apply clip structures comprised of paperboard members to the tops of article groups, such as cans, to thereby join the individual articles into environmentally sound packages. The packaging machines are further designed to apply various paperboard member combinations to various preselected group sizes to provide a variety of completed package units.

SUMMARY OF THE INVENTION

The clip-type article carrier packaging apparatus or system of the present invention comprises various subunits or stations which may be utilized individually or in various combinations with each other to package articles in predetermined group sizes and configurations. The apparatus structure, for example, can be quickly adjusted and/or reconfigured to construct 4, 6, 8 and 12-pack carrier groups of containers such as 12 oz. beverage containers. The packaging system utilizes two-part clip-type article carriers such as those disclosed in the above-referenced pending U.S. patent application of Applicants' assignee. These carriers include a base panel or member and a top panel. The base panel directly mechanically couples with the top of an article group and provides primary structural stability to the group. The top panel provides further stability to the carrier, and also has a flat unobstructed portion for placement of product information and advertising. The top panel may also be of a larger size for combining a pair of base panel engaged groups in a side by side orientation.

The basic apparatus for assembling a predetermined group of articles, for example beverage cans, and constructing a two-part clip-type carrier thereon, generally comprises three (3) stations or sections, each of which accomplishes a particular packaging function. The sections are aligned in a generally linear, continuous orientation. The apparatus longitudinally moves infeed cans from an infeed end, through the stations to an output end. The first station generally comprises parallel and side by side infeed conveyors, infeed timing screw assemblies, first overhead containment belt assemblies, side transfer conveyors (2nd) and lane dividers. The first station further comprises a base panel rotary placer, base panel overhead transfer systems, second overhead containment belt assemblies, outside chime locking wheel assemblies and inside chime locking wheel assemblies. These later elements, along with the timing screw assemblies and the first overhead containment belt assemblies, are disposed on an upper frame structure, the position of which is vertically adjustable for use with varying container sizes and configurations. The second station generally comprises side transfer conveyors (3rd), a top or ad panel rotary placer, top/ad panel overhead transfer mechanisms, overhead containment belt assemblies (3rd), and glue stations. Several of these elements are similarly disposed on an adjustable upper frame which also allows station 2 processing to be disengaged for assembling various group sizes and configurations, for example 8/12 pack processing. The third station generally comprises side transfer conveyors (4th), overhead ad panel flap tucking mechanisms, glue stations, flap compression belt assemblies, outfeed base rollers and a vertically adjustable frame.

An auxiliary packaging apparatus is also provided, which when combined with the basic apparatus yields an overall packaging system capable of assembling various sizes and configurations of carriers such as 8 and 12 packs. The auxiliary apparatus aligns and processes a pair of input side by side oriented product groups, 6-packs for example, into a finished 12-pack carrier. This is accomplished by disengaging the second and third stations of the main apparatus via their vertically movable upper frame mechanisms. The auxiliary apparatus then aligns, deposits and secures a larger 12-pack size top/ad panel over the base panels of two side by side oriented 6-pack groups processed by the basic apparatus to yield a 12-pack carrier.

These and other benefits of this invention will become clear from the following description by reference to the drawings.

DESCRIPTION OF THE PREFERRED EMBODIMENTS

Figures 4, 5:
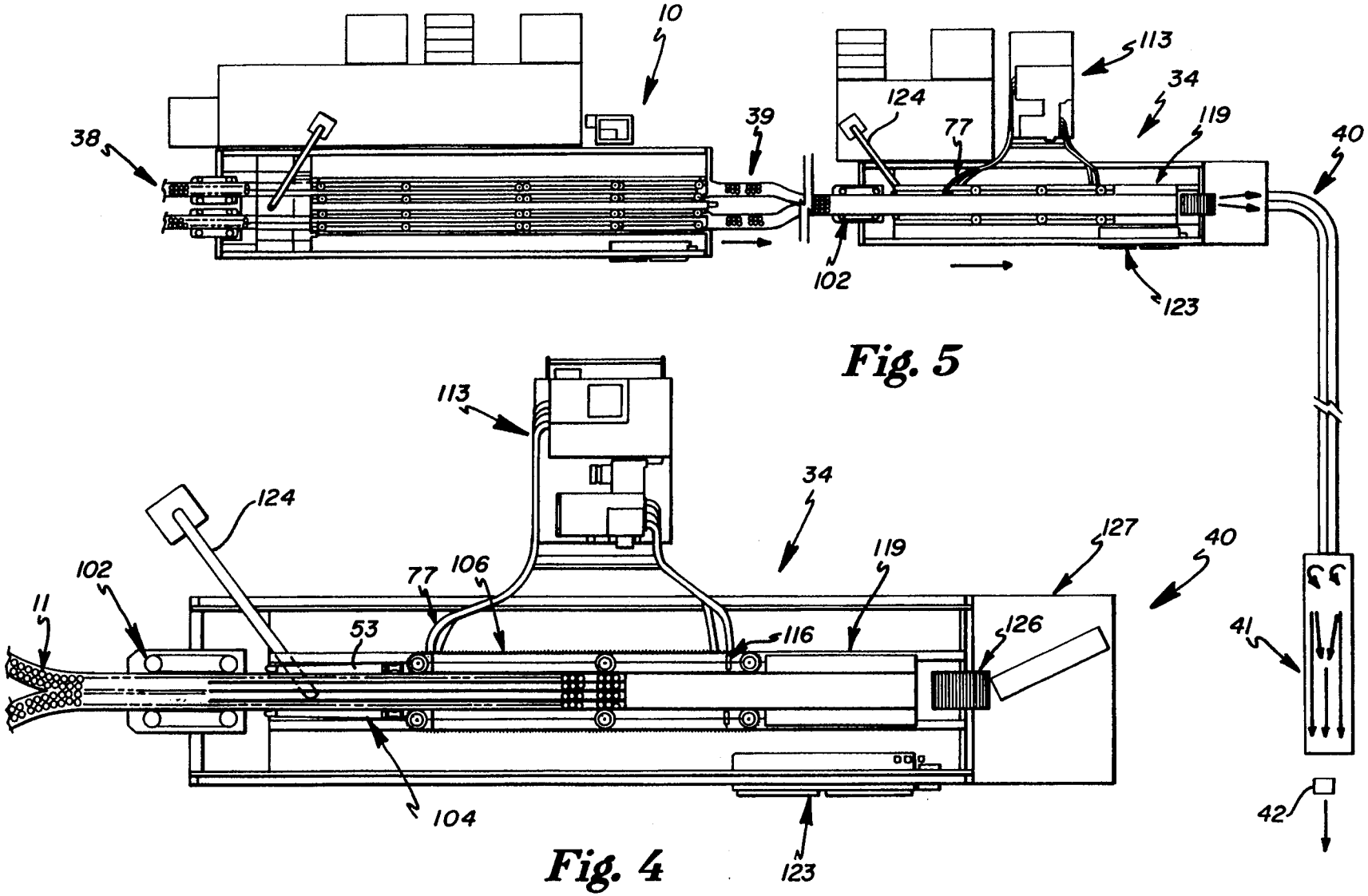
FIG. 4 is a top plan view of the apparatus of FIG. 3.
FIG. 5 is a top plan view of a system utilizing the apparatus shown in FIGS. 1–4.
Figure 8:
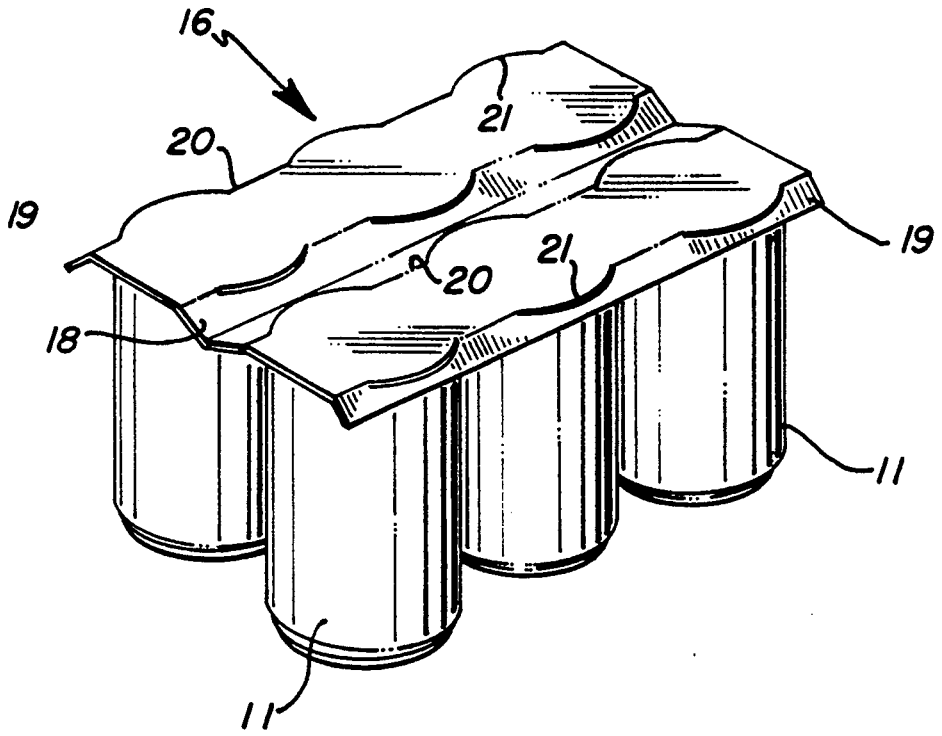
FIG. 8 is a perspective view showing the base panel component in fixed engagement with an exemplary article group comprising a plurality of individual beverage containers.
Figure 9:
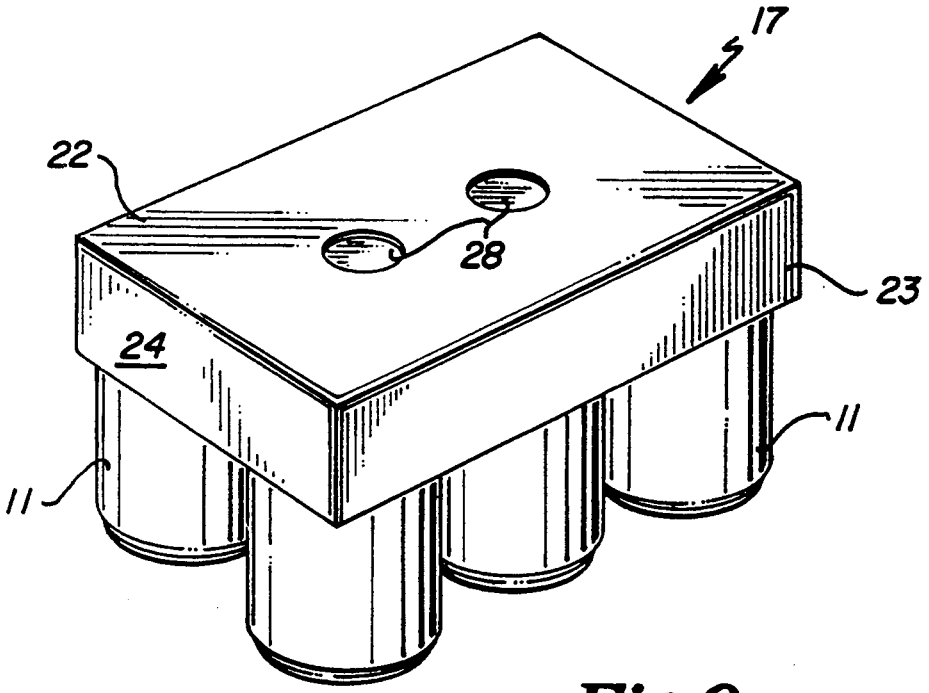
FIG. 9 is a perspective view of a completely assembled carrier, and particularly showing the top or ad panel component overlying the base panel.
Figure 10:
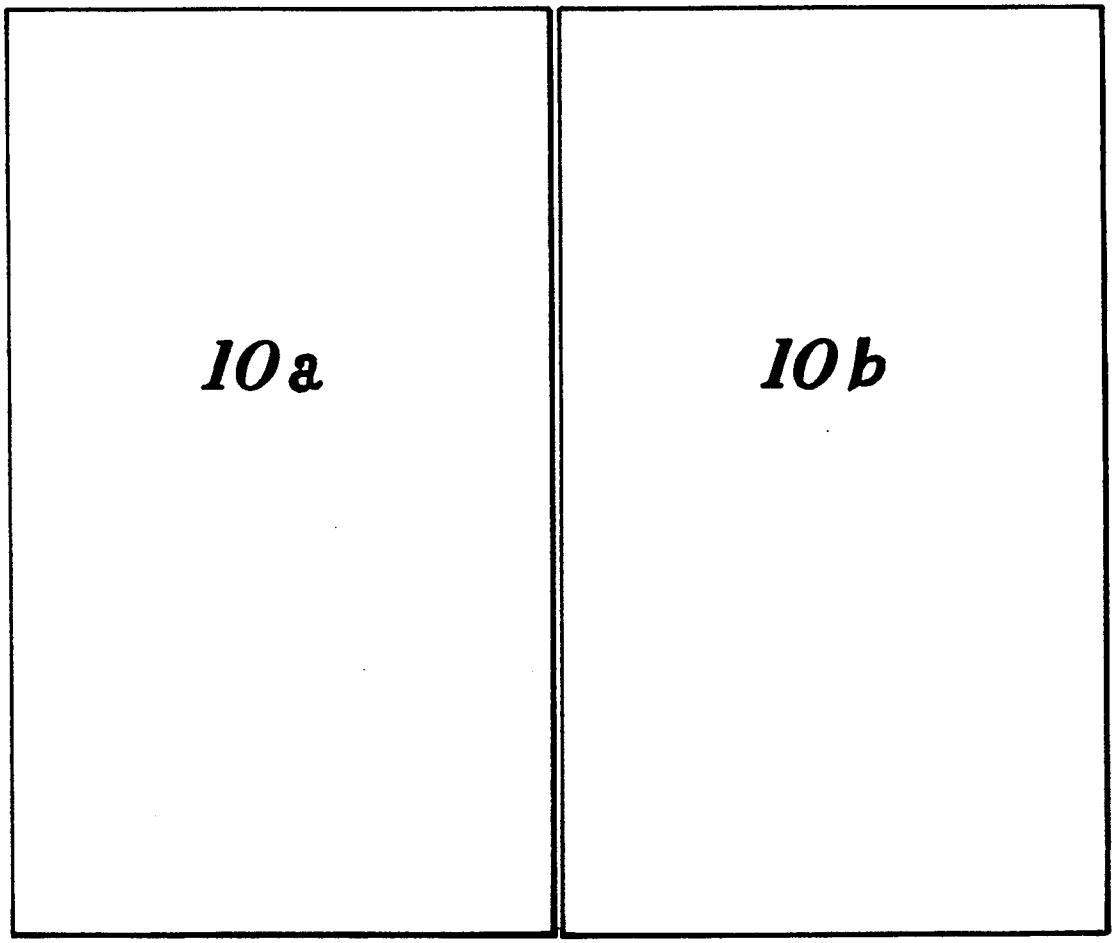
FIG. 10, 10*a* and 10*b* are a side view of a first station of the apparatus shown in FIG. 1.
Figure 10A:
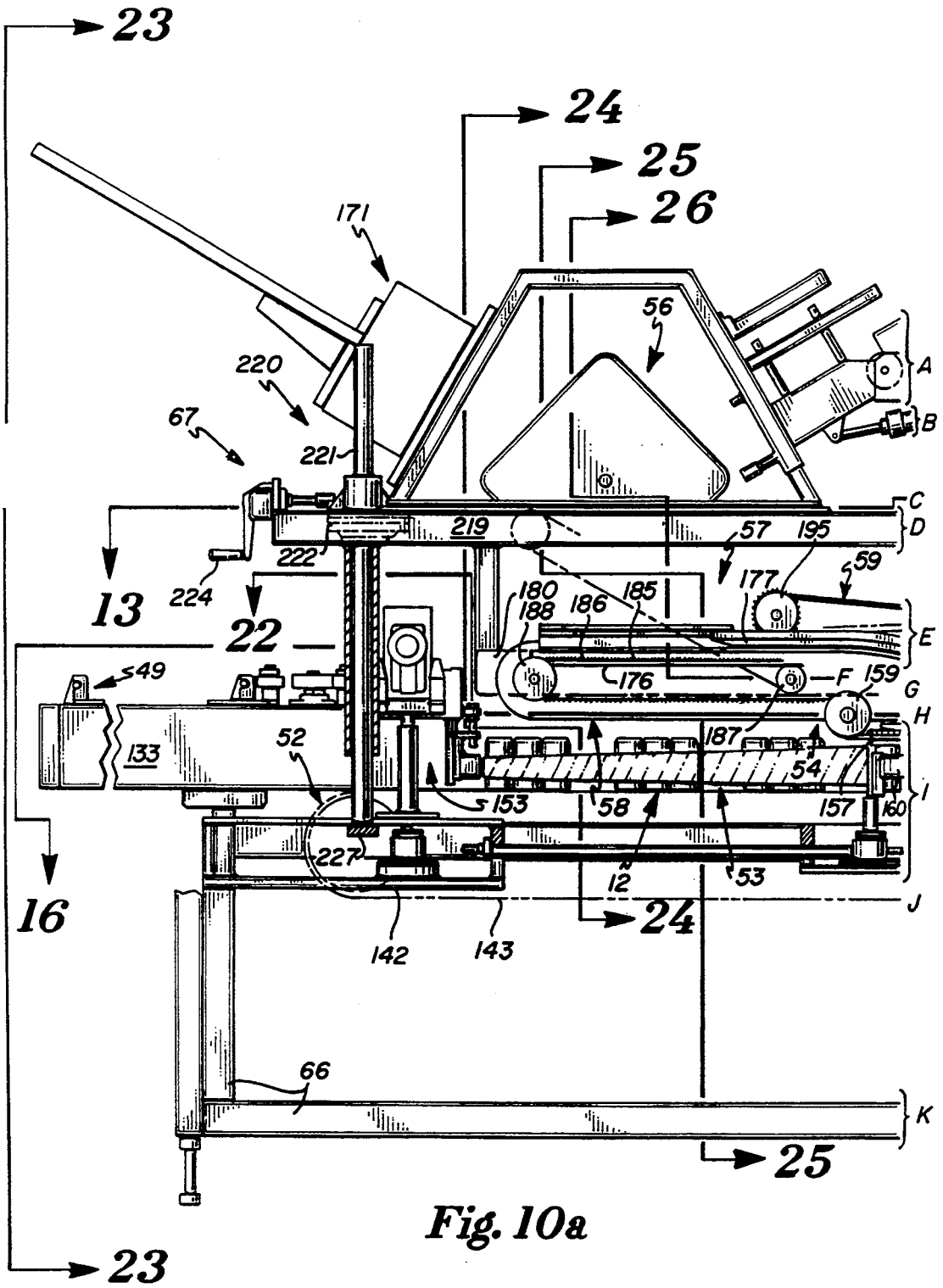
Figure 10B:
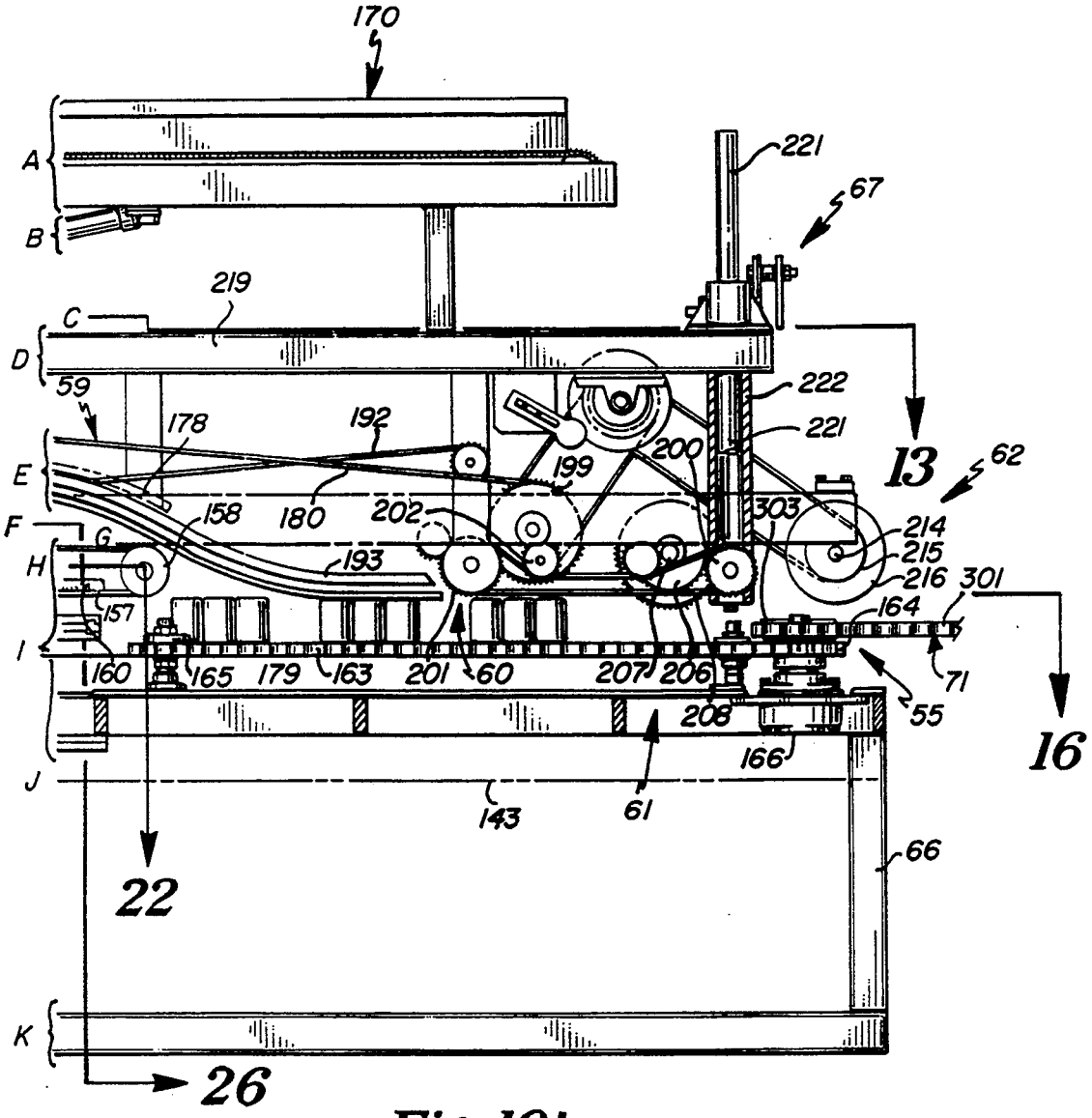
Figure 11:
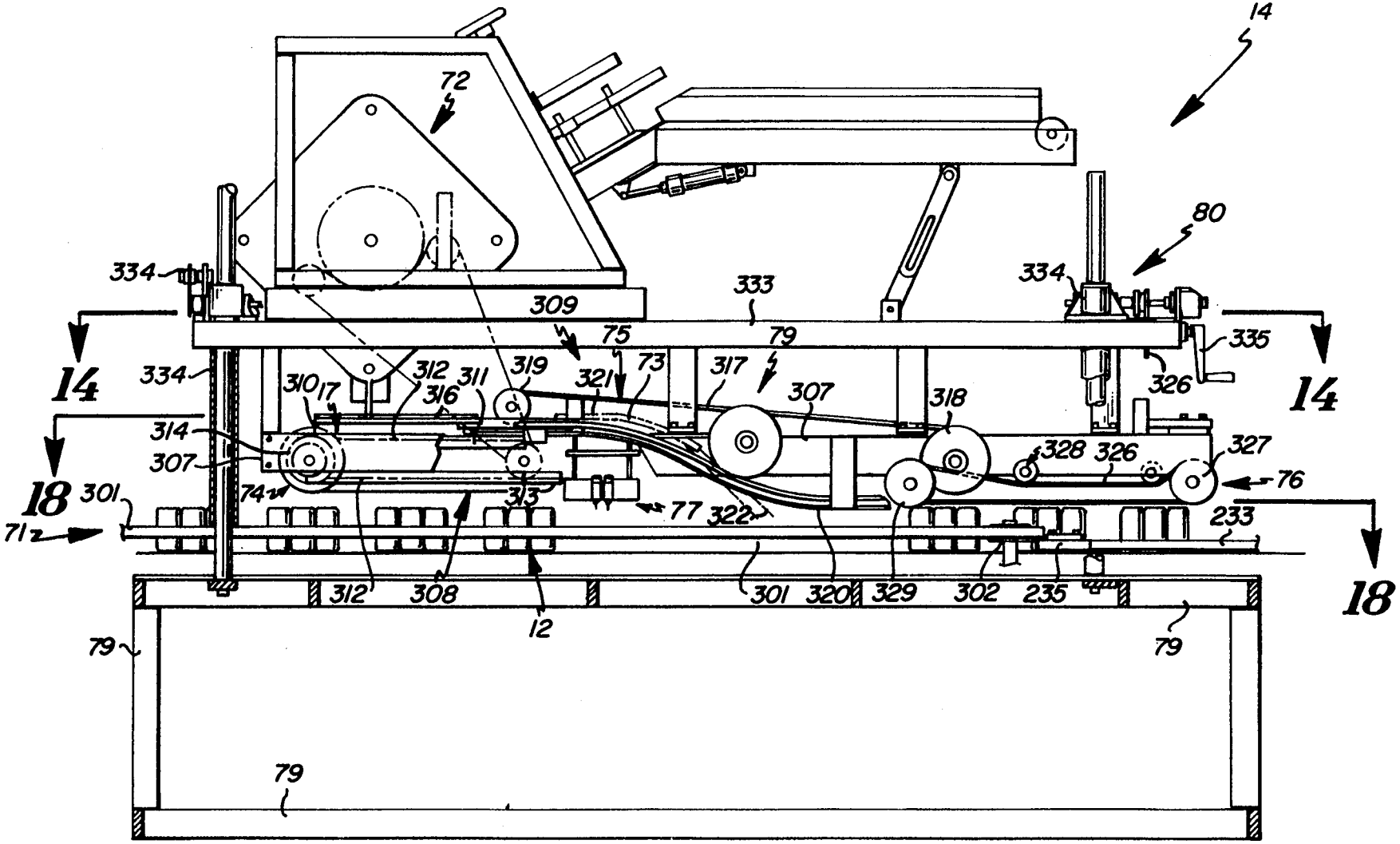
FIG. 11 is a side view of a second station of the apparatus.
Figure 12:
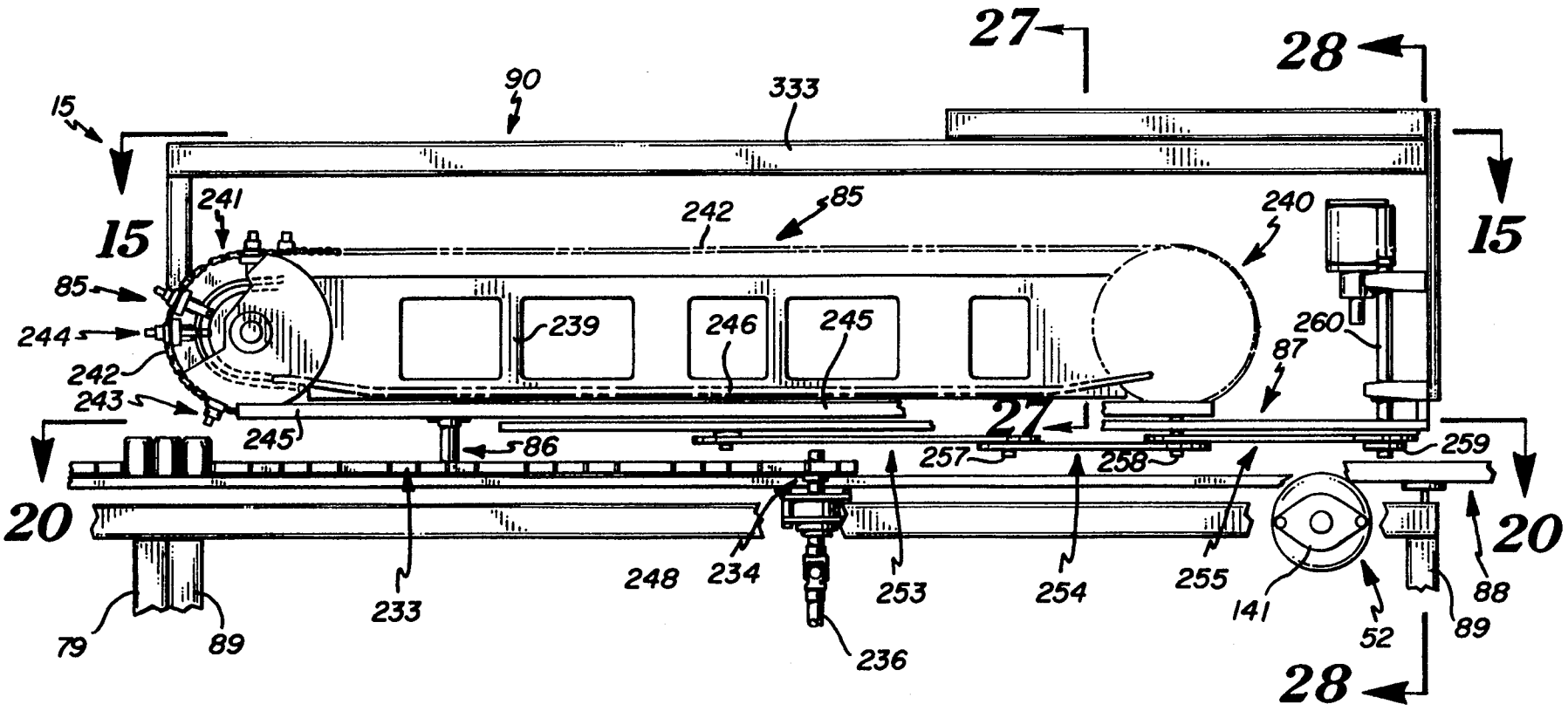
FIG. 12 is a side view of a third station of the apparatus.
Figure 13:
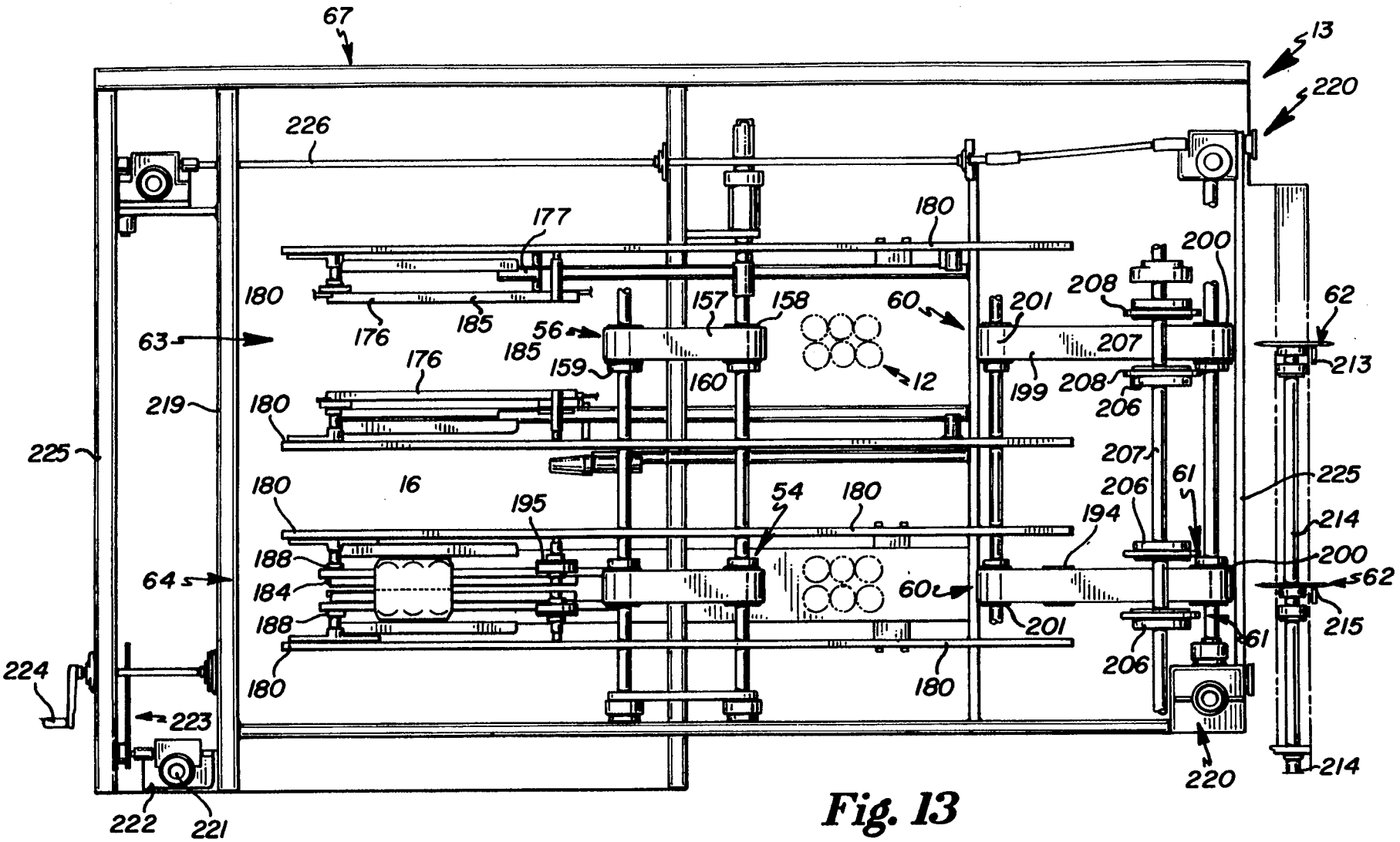
FIG. 13 is a top view of an upper portion of the station 1 apparatus taken along line 13—13 of FIG. 10.
Figure 14:
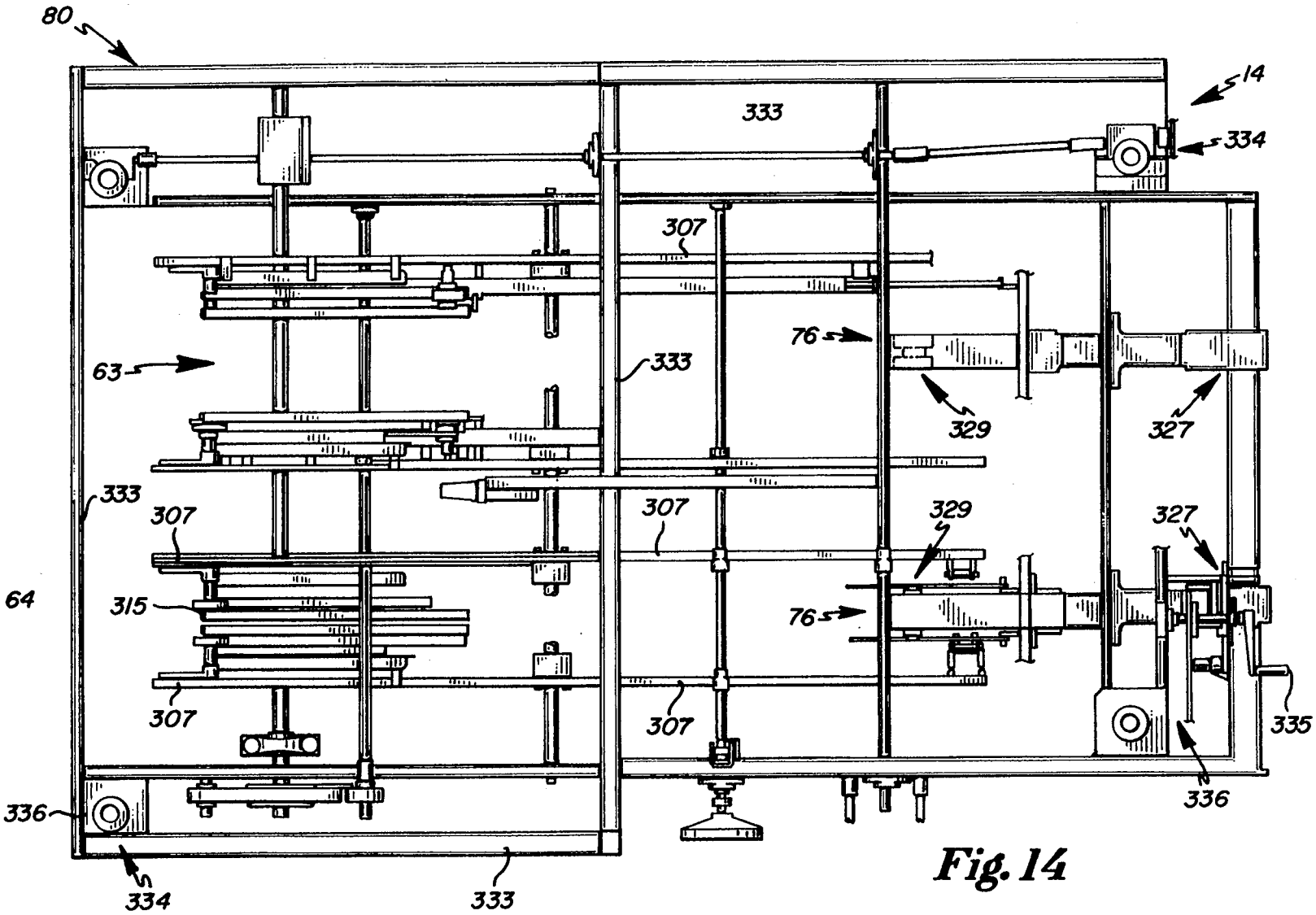
FIG. 14 is a top view of an upper portion of the station 2 apparatus taken along line 14—14 of FIG. 11.
Figure 15:
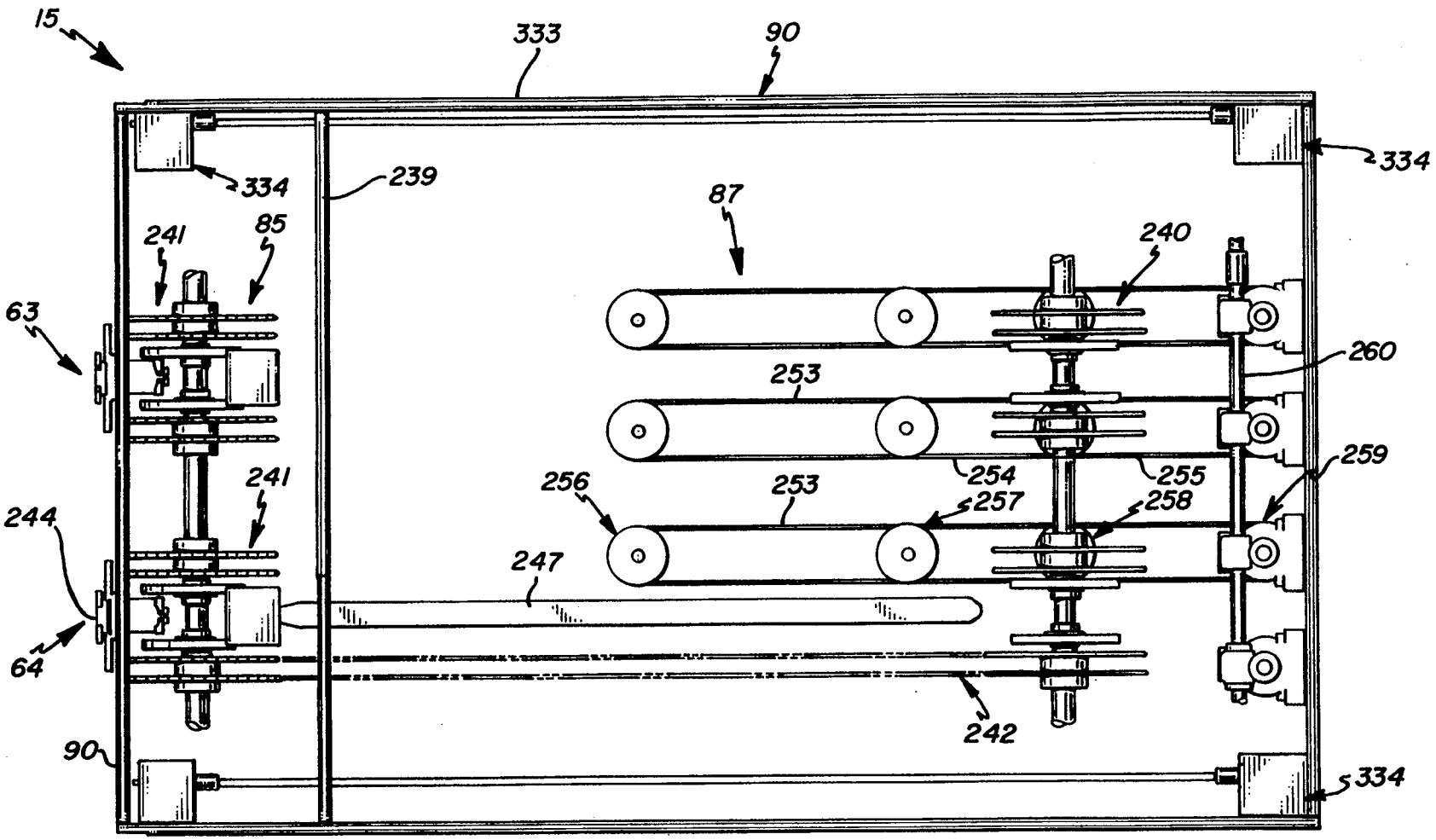
FIG. 15 is a top view of an upper portion of the station 3 apparatus taken along line 15—15 of FIG. 12.
Figure 16:
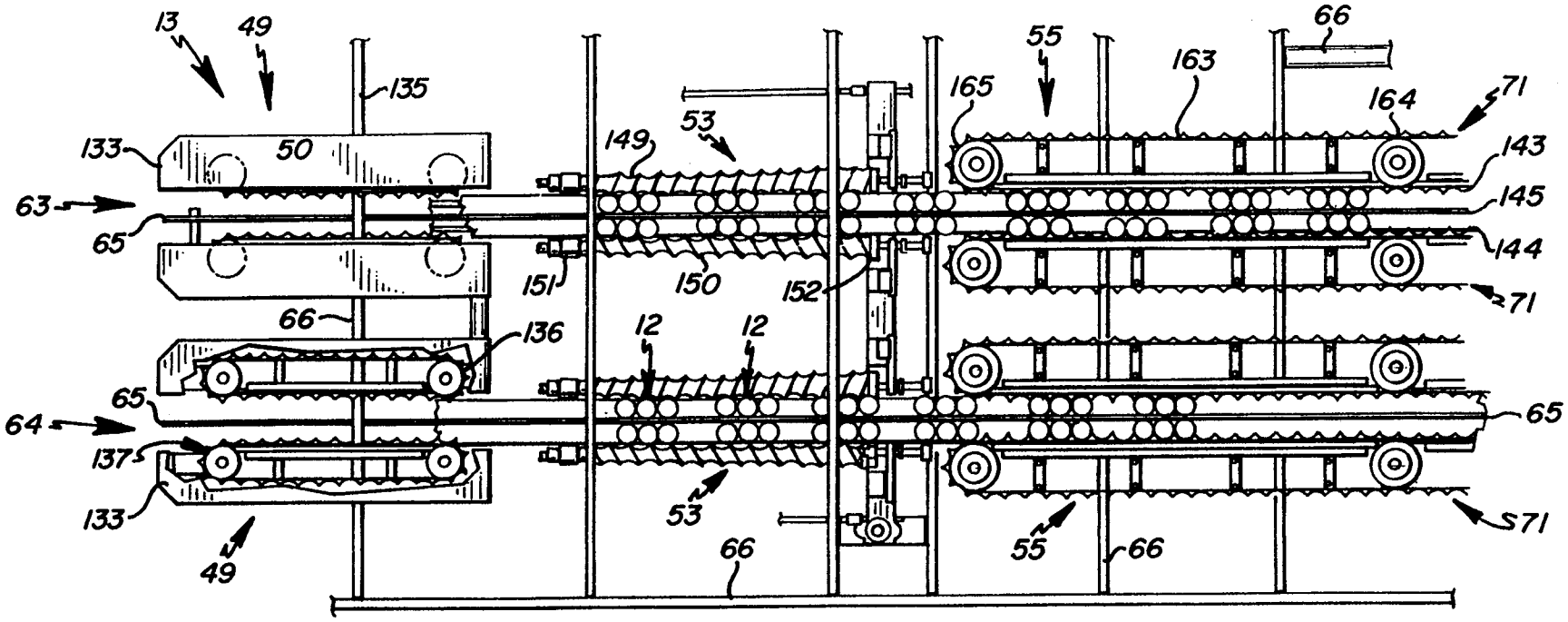
FIG. 16 is a top view of a lower portion of the station 1 apparatus taken along line 16—16 of FIG. 10.
Figure 17:
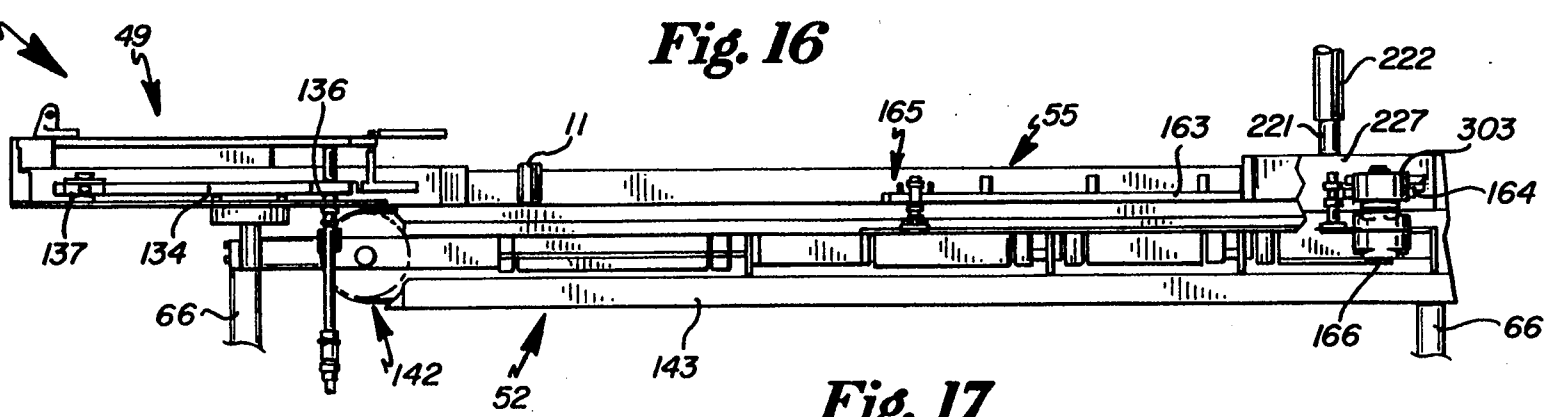
FIG. 17 is a side view of the apparatus of FIG. 16.
Figure 18:
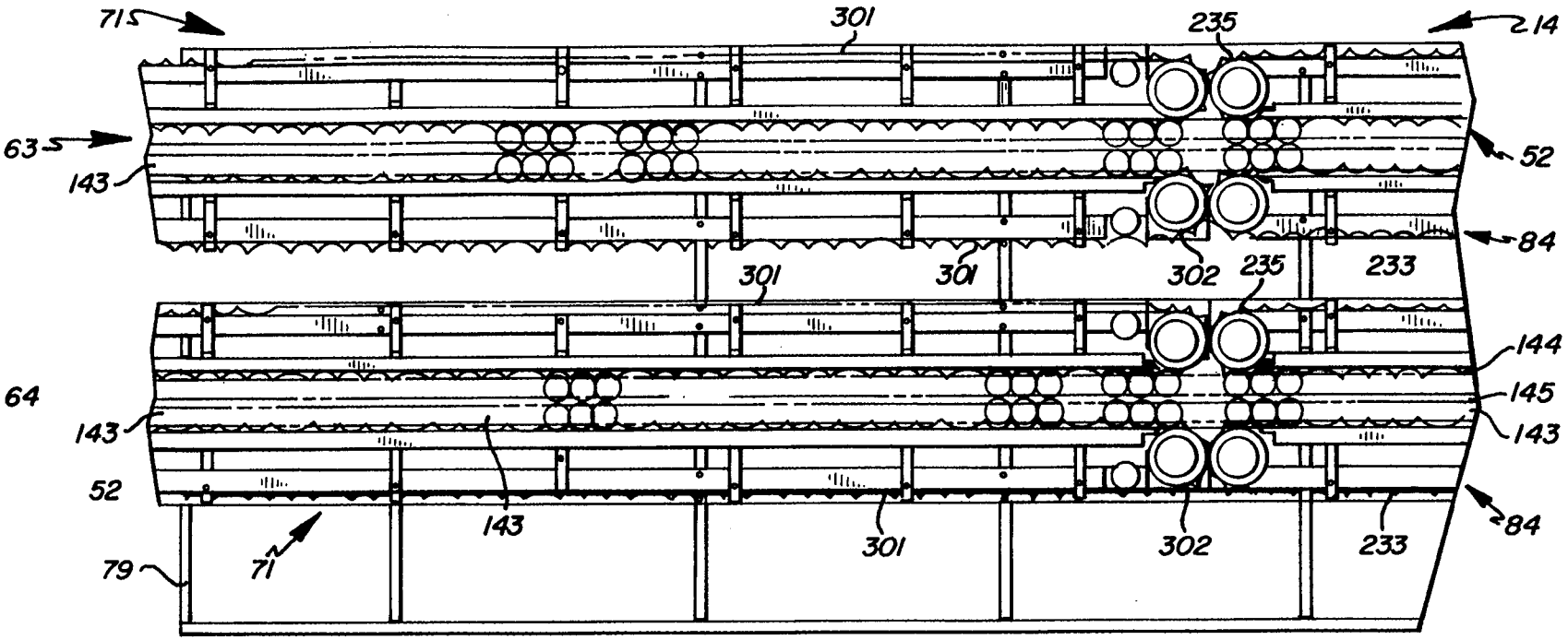
FIG. 18 is a top view of a lower portion of the station 2 apparatus taken along line 18—18 of FIG. 11.
Figure 19:
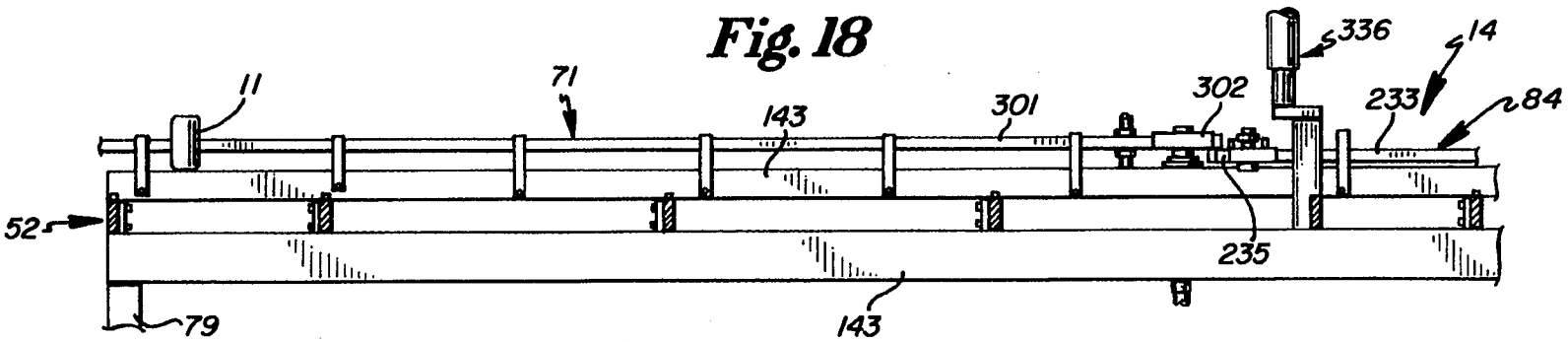
FIG. 19 is a side view of the apparatus of FIG. 18.
Figure 20:
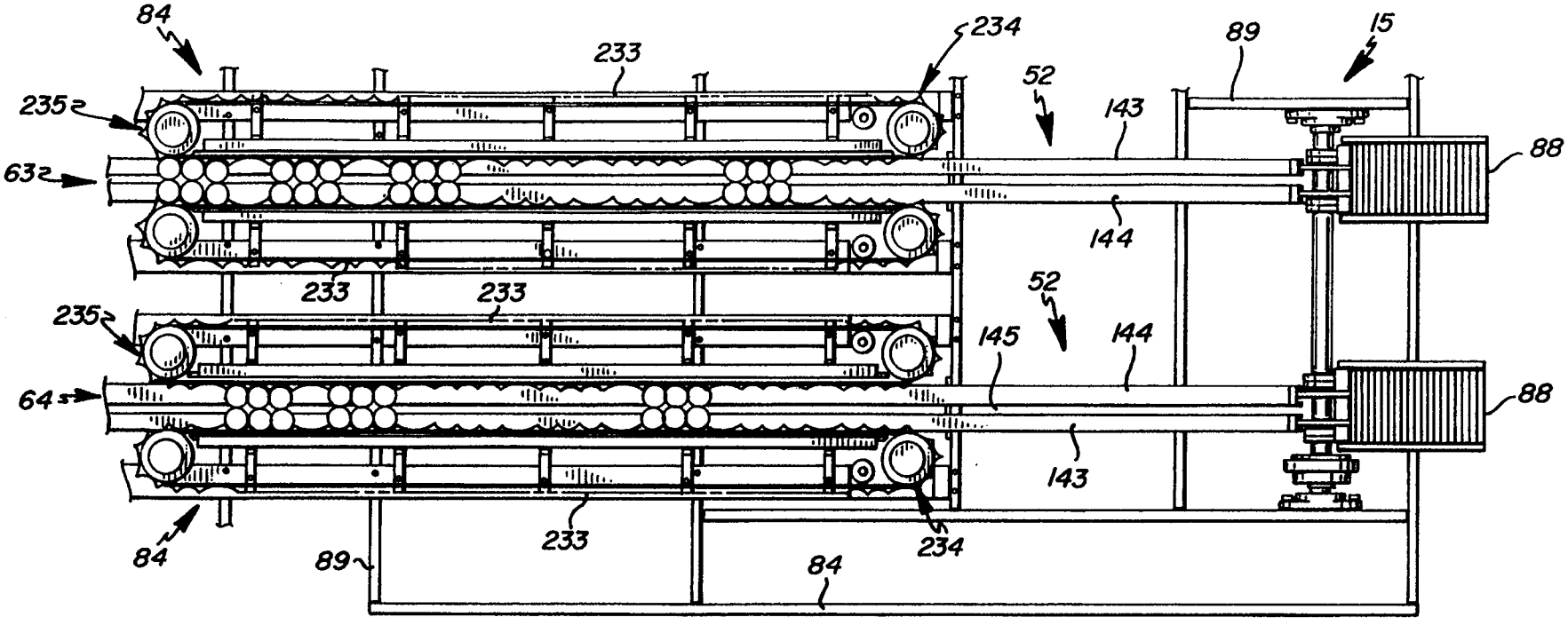
FIG. 20 is a top view of a lower portion of the station 3 apparatus taken along line 20—20 of FIG. 12.
Figure 21:
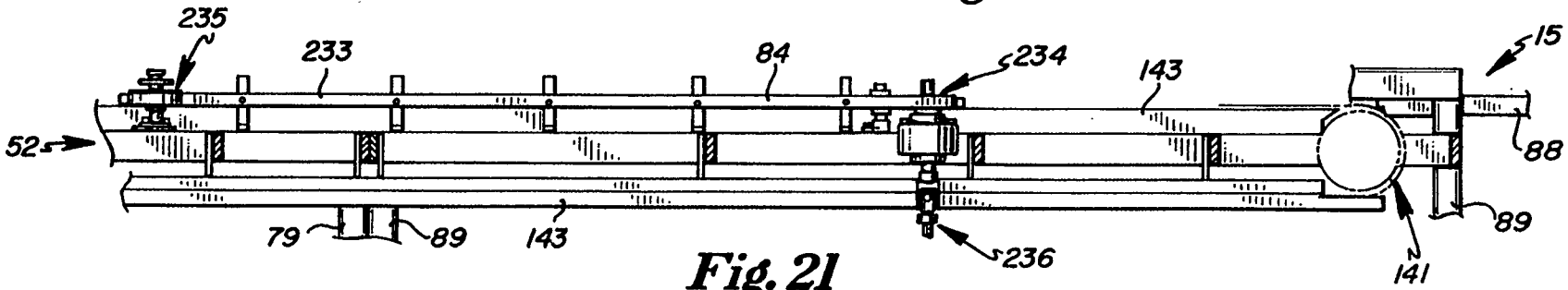
FIG. 21 is a side view of the apparatus of FIG. 20.
Figure 22:
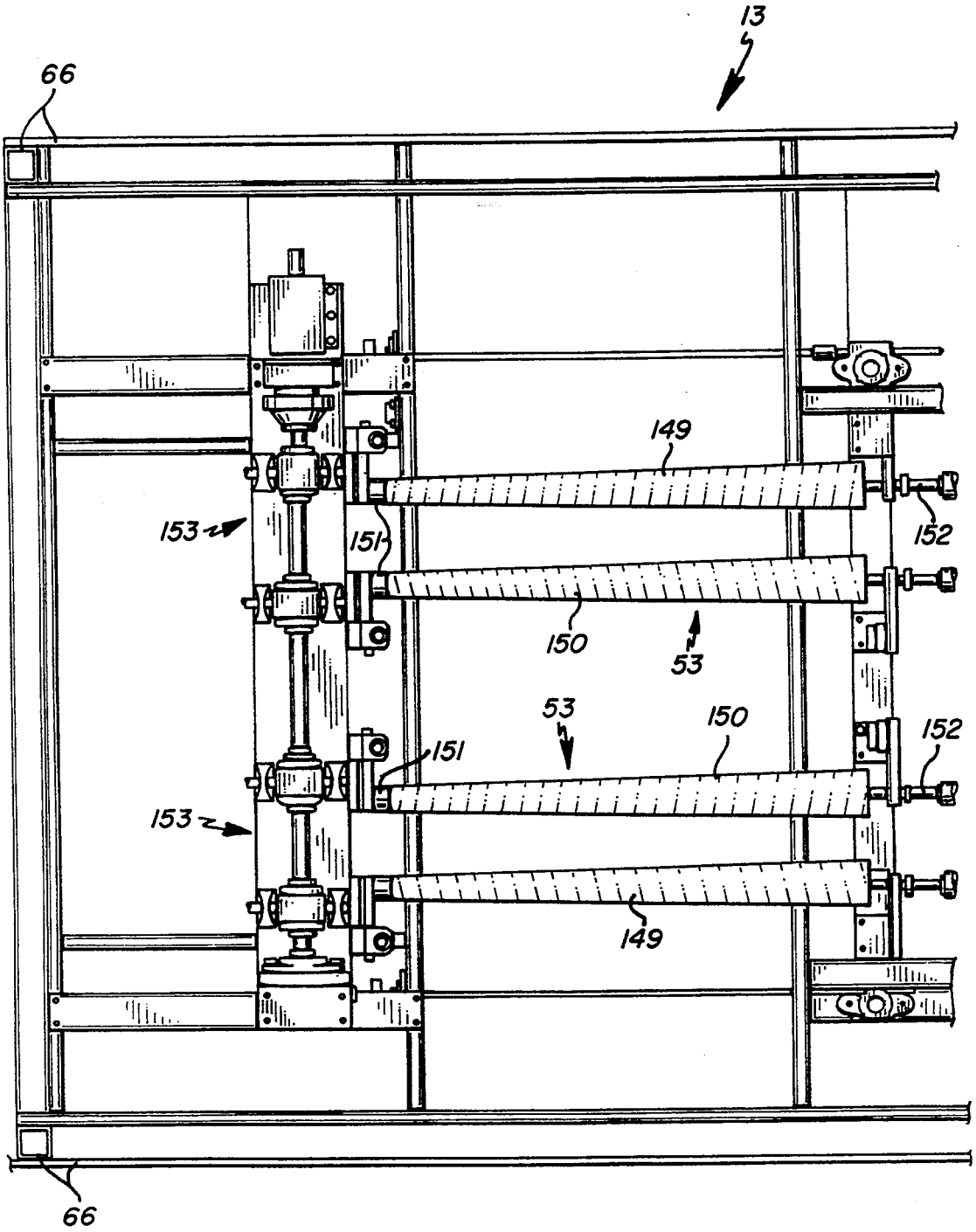
FIG. 22 is a top view of the station 1 apparatus taken along line 22—22 of FIG. 10.
Figure 23:
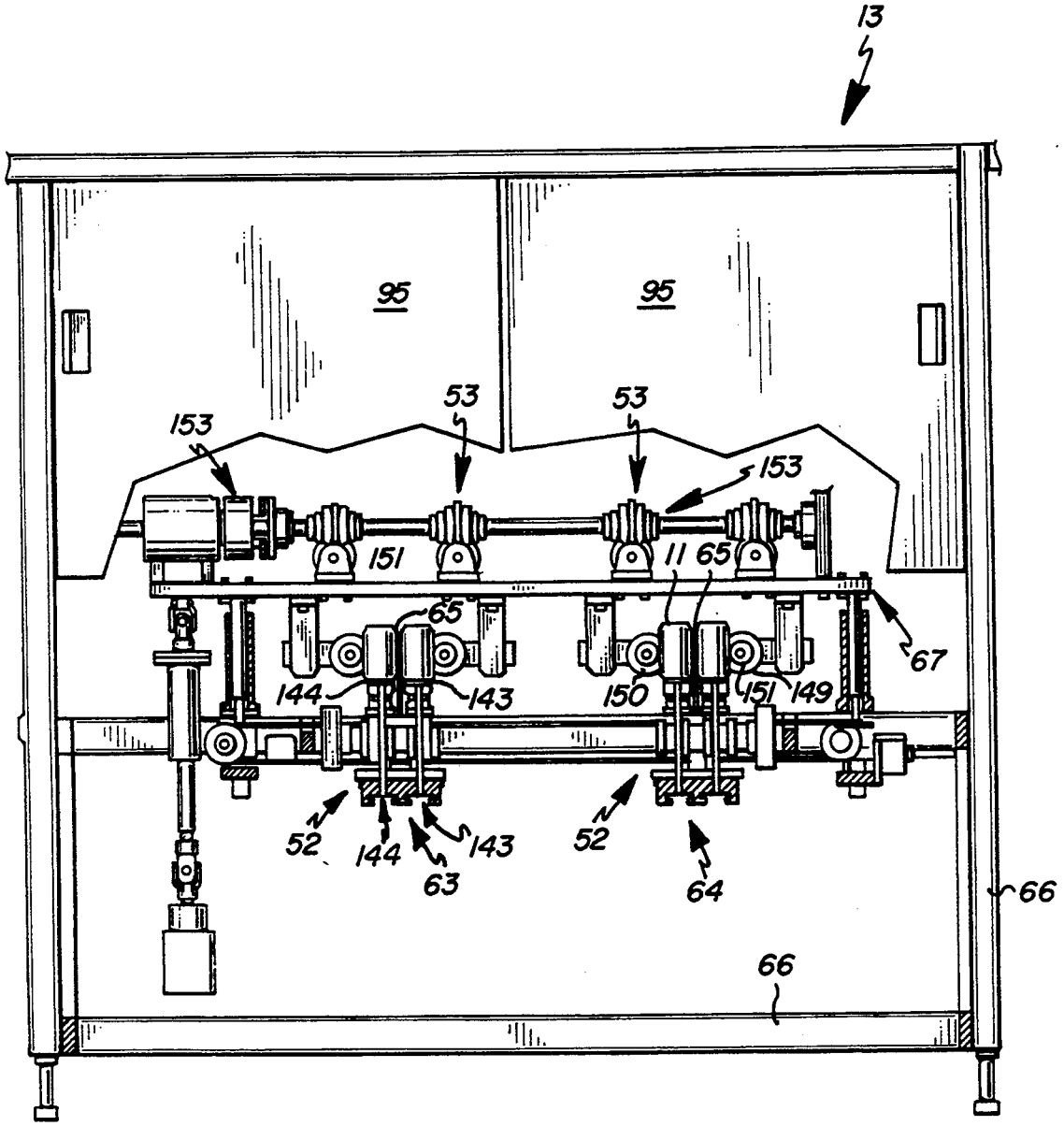
FIG. 23 is a crossectional view of the station 1 apparatus taken along line 23—23 of FIG. 10.
Figure 24:
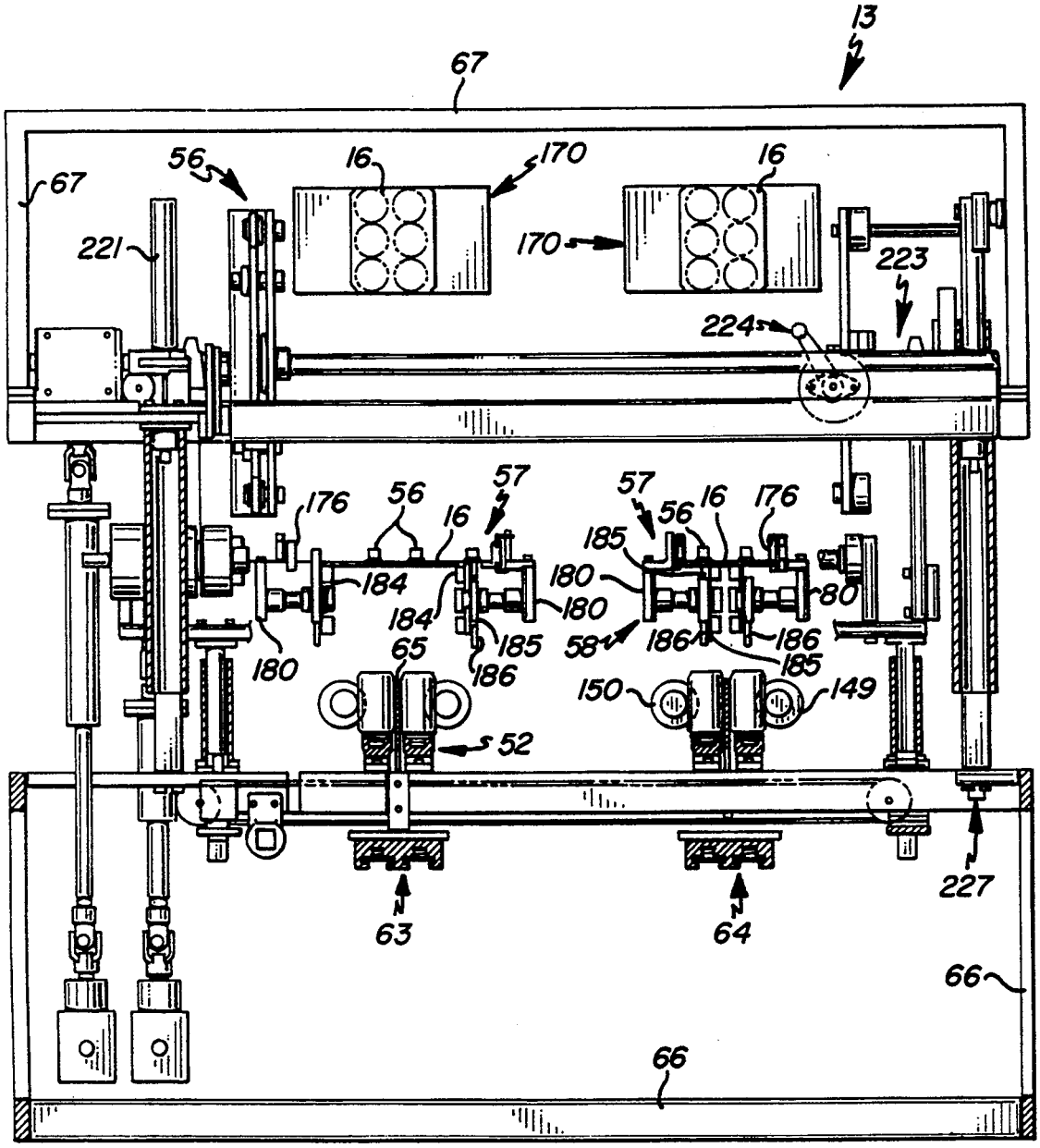
FIG. 24 is a crossectional view of the station 1 apparatus taken along line 24—24 of FIG. 10.
Figure 25:
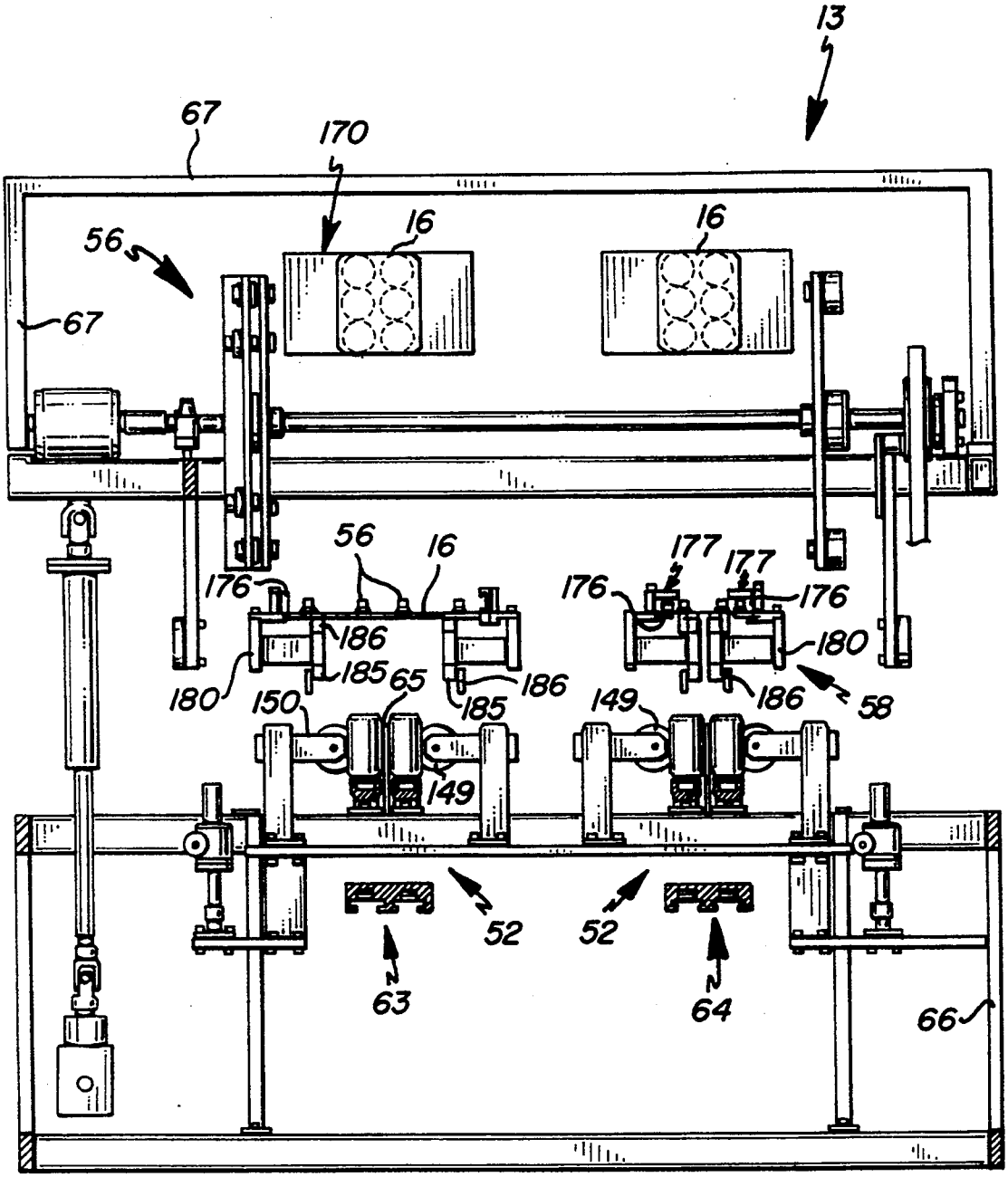
FIG. 25 is a crossectional view of the station 1 apparatus taken along line 25—25 of FIG. 10.
Figure 26:
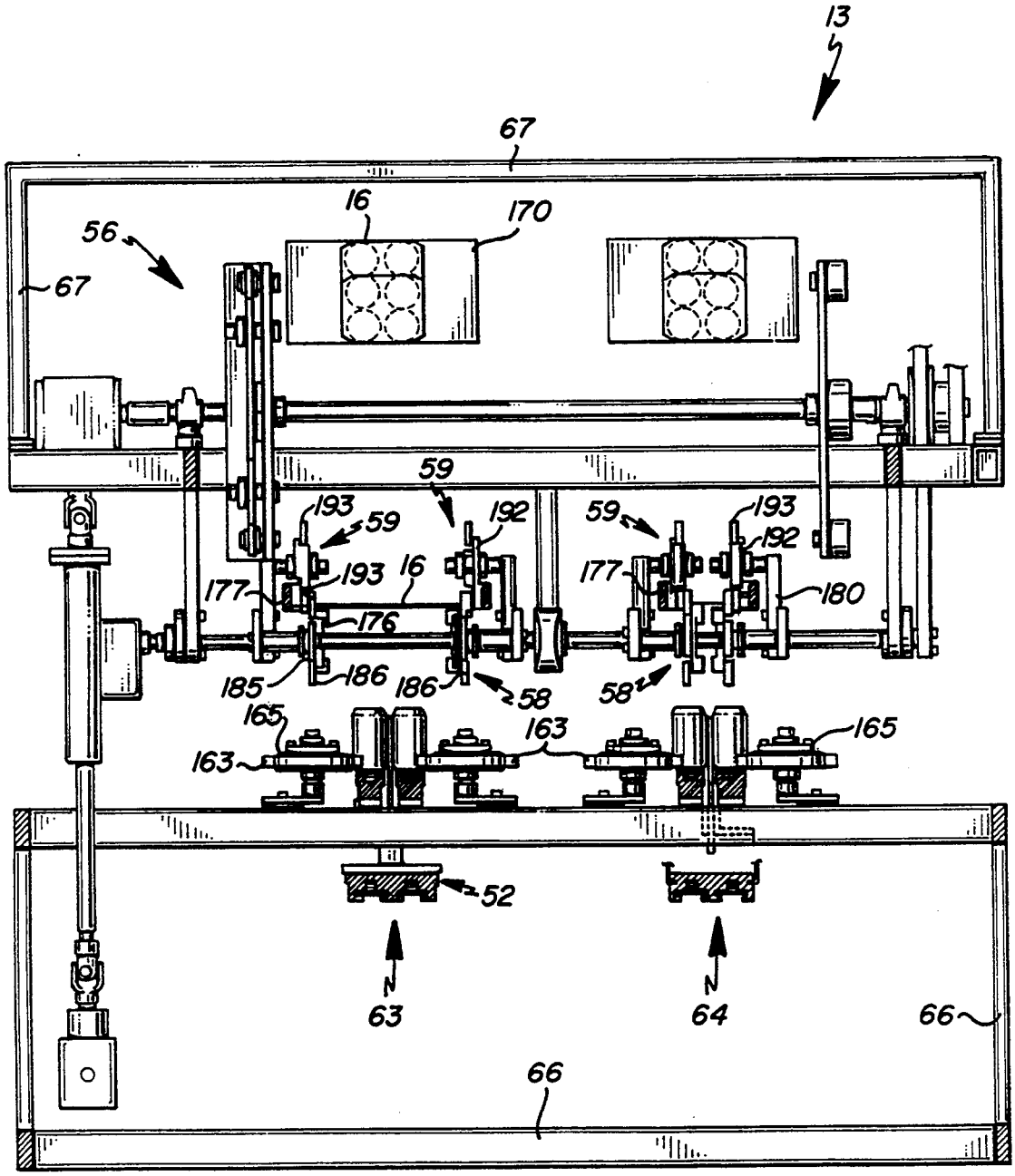
FIG. 26 is a crossectional view of the station 1 apparatus taken along line 26—26 of FIG. 10.
Figure 27:
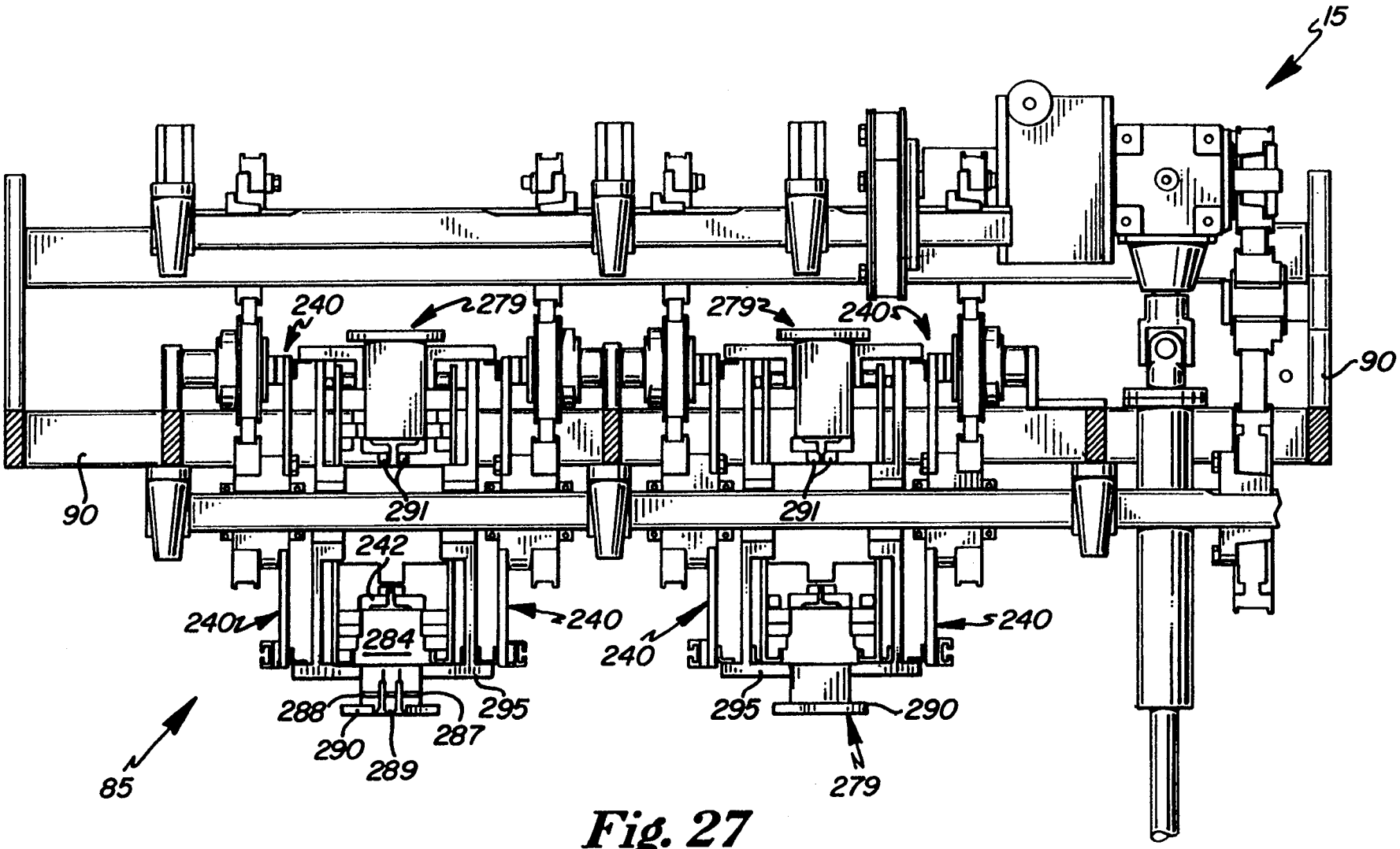
FIG. 27 is a crossectional view of the station 3 apparatus taken along 27—27 of FIG. 12.
Figure 28:
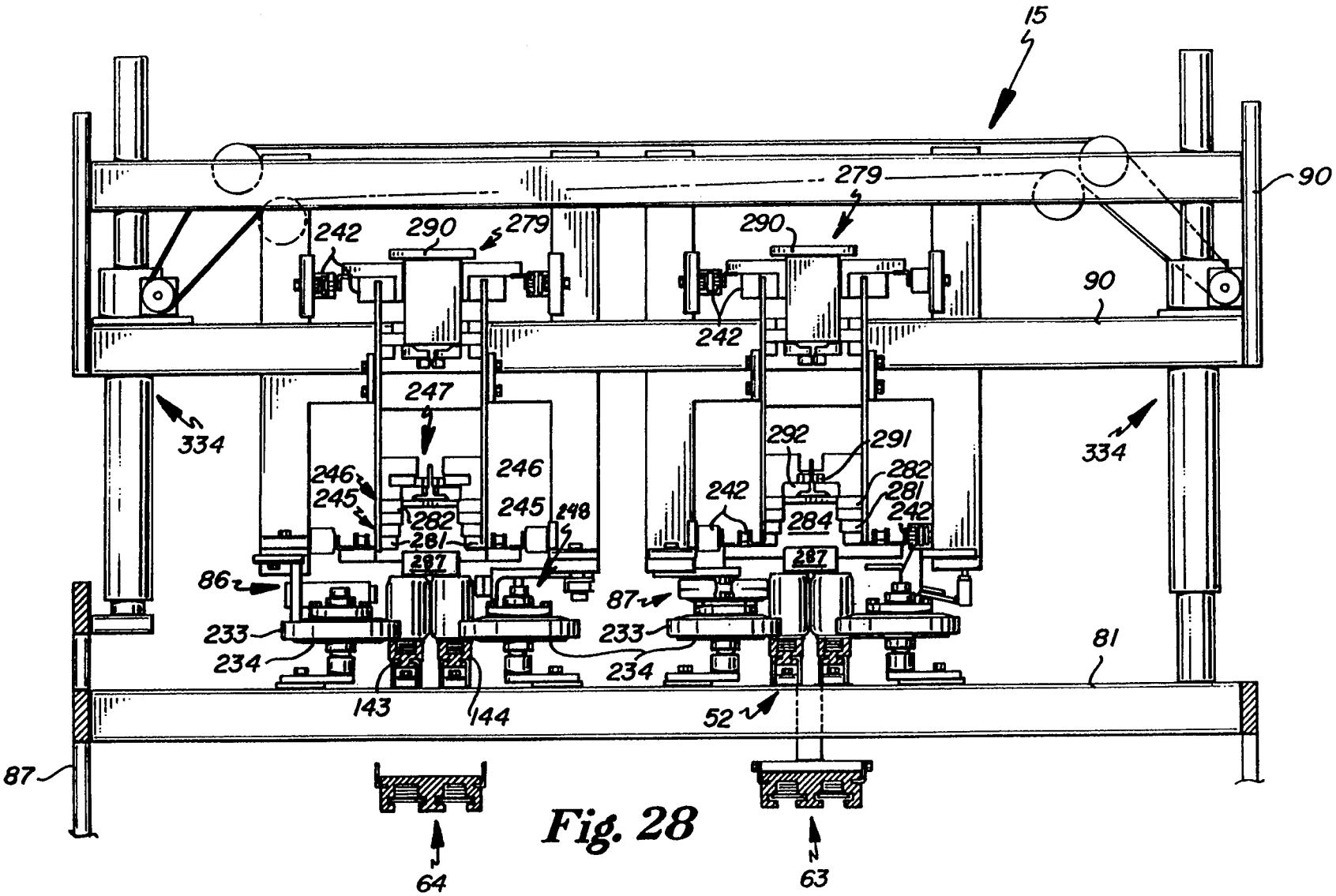
FIG. 28 is a crossectional view of the station 3 apparatus taken along 28—28 of FIG. 12.

Referring to FIGS. 1–5, the clip-type article carrier packaging apparatus and system of the present invention comprises various sub-units or stations which may be utilized individually or in various combinations with each other, to package articles such as containers in predetermined group sizes and configurations ranging from 4-packs to 12-packs in the case of standard size, 10 to 12 ounce beverage cans. The exemplary embodiment of the apparatus 10 shown in FIGS. 1, 2 and 10–30 is configured for preparing 6-pack carriers for and of standard diameter beverage cans having heights ranging from 3.25 to 7 inches. The apparatus 10 has the capacity to process approximately 2400 cans per minute (in 6-packs) with two lanes having a speed of approximately 200 cycles per minute per lane. And, this invention teaches apparatus structure which can be quickly adjusted and/or reconfigured to construct 4-pack carrier groups and other carrier groups having various sizes and types of containers. Additionally, when this base apparatus is combined with the apparatus shown in FIGS. 3 and 4, a system is generated (as shown in FIG. 5) that combines 4 or 6 pack base sub-units to ultimately yield completed 8 or 12 pack carrier configurations. Moreover, as will be apparent to those skilled in the art, the teachings of this invention are applicable to apparatus for packaging various container or article types, sizes and configurations, and in various group sizes and configurations.

Referring to FIGS. 6–9, this packaging system utilizes two-part clip-type article carriers such as those disclosed in the above-referenced pending U.S. patent application of Applicants' assignee. These carriers include a base panel or member 16 and a top or ad panel 17. The base panel 16 directly mechanically couples with the top of an article group and provides primary structural stability to the container group. The base panel 16 may be varied in size and is preferably constructed with a high content of recycled materials, for economical and environmental reasons, as it is covered or overlapped by the top panel 17. The top panel 17 provides additional stability to the carrier, and also preferably has a flat unobstructed portion 22 for placement of product information and advertising. Several embodiments of the top panel are known, including flapped structures which mate with a single article group and base panel, and those which mate with and combine a pair of adjacent article groups, via their base panels. Non-flapped top panels also exist. The base and/or top panels 16 and 17 may further have carrying structures such as cut outs 28. As shown, the base panel 16 has a pair of parallel flat surfaces defined by opposing rows of interconnected fold lines 20 and curved chime engaging slits 21. A depressable central rib 18 separates the two flat surfaces, while side reinforcing strips 19 delineate the periphery of the base 16. The top panel 17 has a central top surface 22 with a pair of side flaps 23 and a pair of end flaps 24 connected to the top surface 22 at fold lines 25. The end flaps 24 further have extended minor flaps or tabs 27 at two ends. Although, in FIG. 9, the folded flaps 23 and 24 are shown to form a square edge configuration, a banded-type radius edge is preferred for maintaining a tight final carrier configuration.

Figure 1:
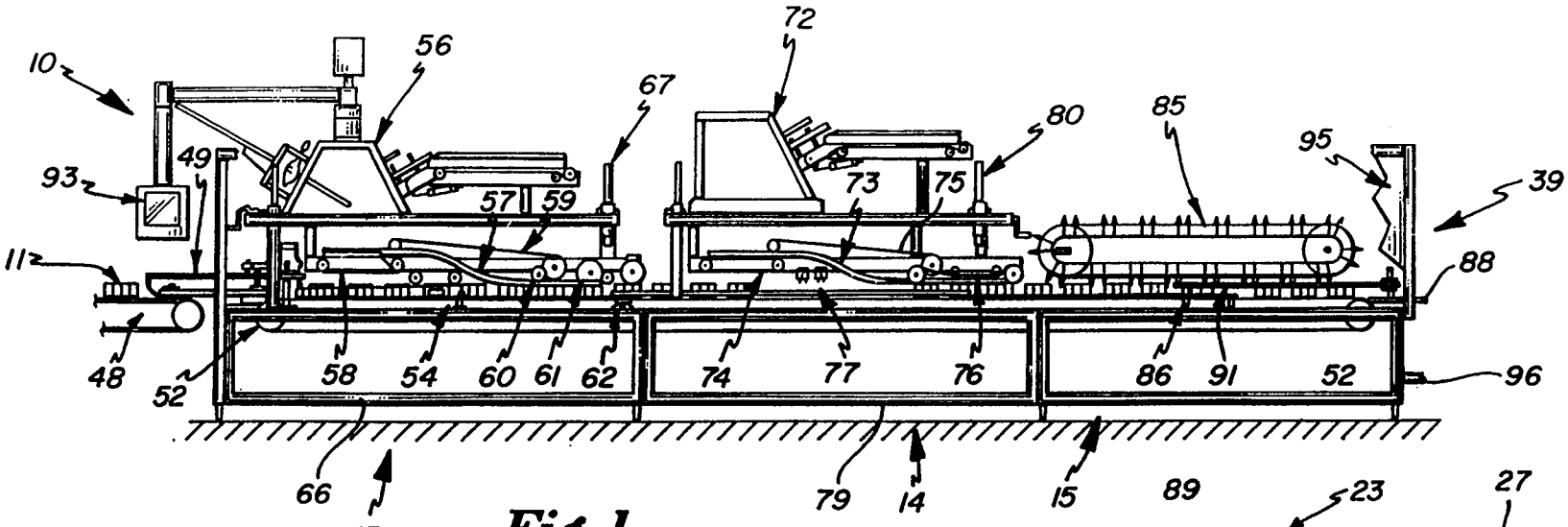
FIG. 1 is a side view of a basic apparatus for assembling clip-type article carriers in accordance with the present invention.
Figure 7:
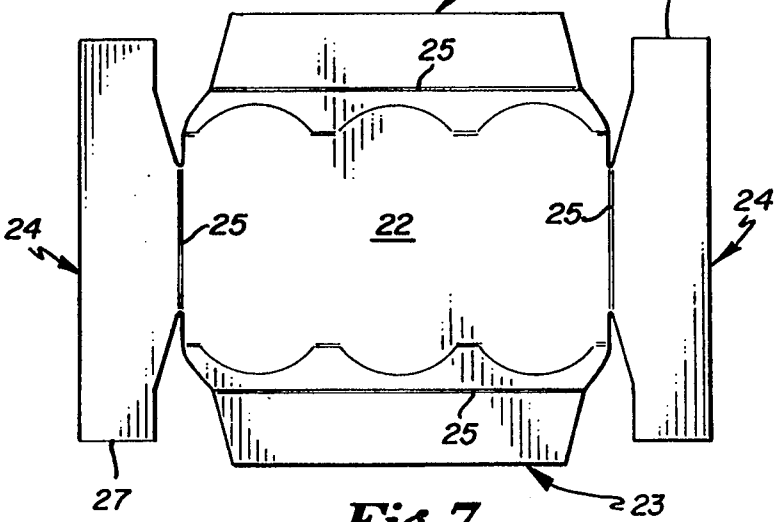
FIG. 7 is a top plan view of a top or ad panel component of the clip-type article carrier which is assembled by the apparatus of this invention.
Figure 6:
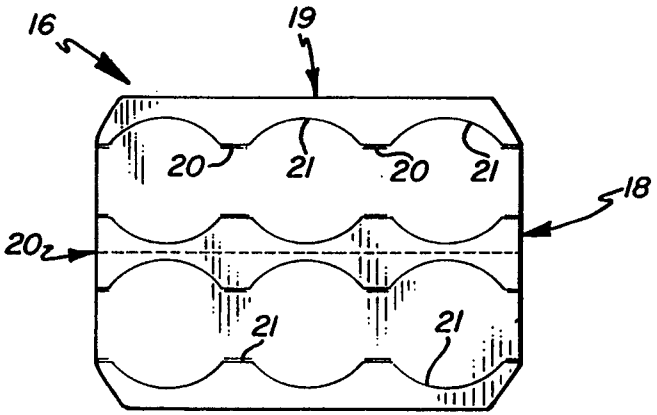
FIG. 6 is a top plan view of a base panel component of the clip-type article carrier which is assembled by the apparatus of this invention.
Figure 2:
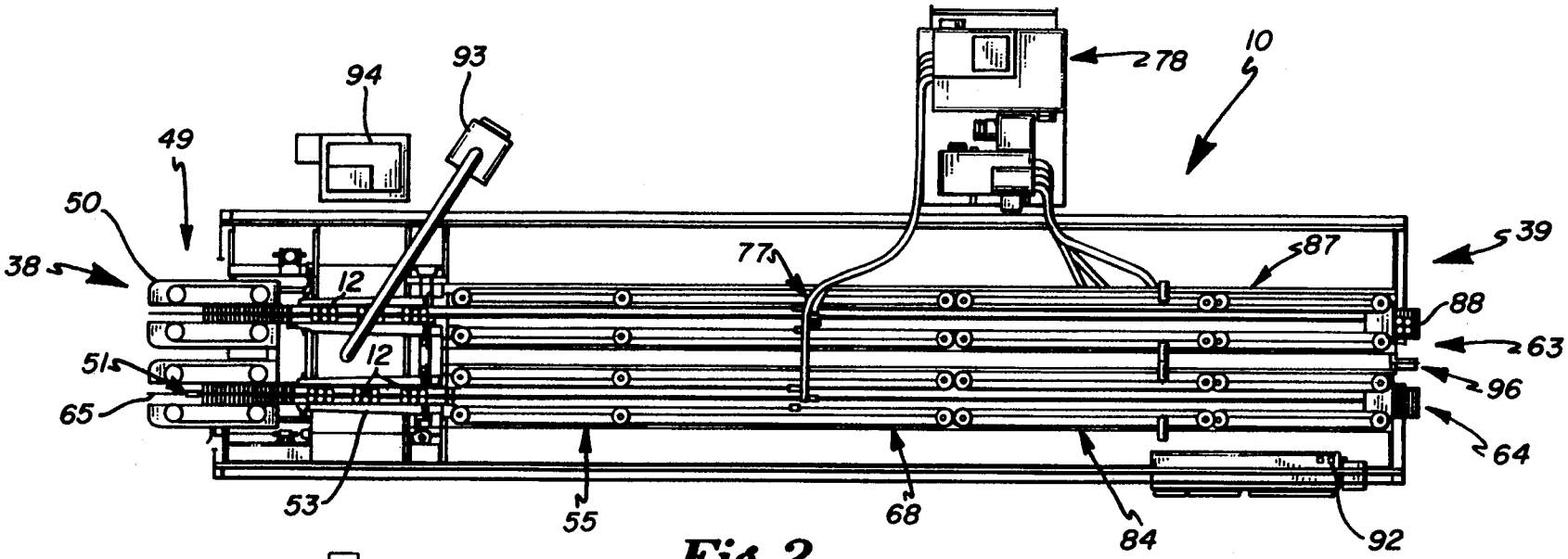
FIG. 2 is a top plan view of the apparatus shown in FIG. 1.

FIGS. 1 and 2 show the basic apparatus 10 for assembling a 6-pack group of beverage cans and constructing a two-part clip-type carrier thereon. The apparatus 10 generally comprises three (3) stations or sections 13, 14 and 15, each of which accomplishes a particular packaging function. The sections 13, 14, and 15 are shown aligned in a generally linear, continuous orientation. The apparatus 10 longitudinally moves infeed cans 11 from an upstream or infeed end 38 to a downstream or output end 39, through the stations 13–15. The products 11 are shown transported in a pair of parallel, side by side lanes or conveyance paths 63 and 64 for maximum efficiency, although a single lane or additional lanes are also permitted consistent with the general teachings of the invention. The lanes 63 and 64 are further defined by a pair of trans-station throughput conveyors 52 which extend longitudinally through all three stations 13–15. The containers 11 are shown delivered to the input end 38 via a conveyor apparatus 48 which is part of the upstream beverage packaging process. As shown, the stations 13–15 are constructed on and supported by a unitary frame structure consisting of cooperating frame segments 66, 79 and 89.

The first station 13 generally comprises parallel and side by side infeed conveyors 49, infeed timing screw assemblies 53, first overhead containment belt assemblies 54, side transfer conveyors 55 (2nd) and lane dividers 65. These elements basically cooperate with the throughput conveyor 52 to meter and transport container groups 12 through the station 13. This station 13 further comprises a base panel rotary placer 56, base panel overhead transfer systems 57, second overhead containment belt assemblies 60, outside chime locking wheel assemblies 61 and inside chime locking wheel assemblies 62. The later elements basically cooperatively function to align base panels 16 with the moving product groups 12 and to engage the panels 16 with the top surface of the group 12 at a predetermined point. Also, these later elements, along with the timing screw assemblies 53 and the first overhead containment belt assemblies 54, are disposed on an upper frame structure 67, the position of which is vertically adjustable for use with varying container sizes and configurations.

The second station 14 generally comprises side transfer conveyors 71 (3rd), a top or ad panel rotary placer 72, top/ad panel overhead transfer mechanisms 73, overhead containment belt assemblies 76 (3rd), and glue stations 77. The side transfer conveyors 71 cooperate with the throughput conveyors 52 to receive spaced, metered article groups (with engaged base panels 16) from the first station 13 and to transport them in such spaced orientation through the second station 14. The remaining elements function to align and engage container top/ad panels 17 with the moving product groups 12, at the top surface (base panel 16) thereof. These elements are also disposed on an adjustable upper frame 80. The vertically movable frame 80 also allows second station 14 processing to be disengaged for assembling various group sizes and configurations, for example 8/12 pack processing, as will be discussed further below. A glue supply cart 78 is shown communicatively coupled to the glue stations 77.

The third station 15 generally comprises side transfer conveyors 84 (4th), overhead ad panel flap tucking mechanisms 85, glue stations 86, flap compression belt assemblies 87 and outfeed base rollers 88. These station elements are also disposed on a vertically adjustable upper frame 90, and operate on the flaps of the top/ad panel 17 (the panel 17 previously having been adhesively mated to the top surface of the base panel 16 at second station 14) to yield a folded, completed carrier unit, for example a 4 or 6 pack beverage carrier.

Also shown in FIGS. 1 and 2, are a main electrical enclosure 92, a remote operator station 93, an outer frame and guards 95, and a main drive shaft 96. The drive shaft 96 is connected to a power source, for example a 15 horsepower electric motor, and provides power to and synchronizes the operation of the above-described systems and assemblies via various gear assemblies, belts, chains, and shaft drives. The drive shaft 96 is coupled to a toothed clutch (not shown) disposed at each station 13, 14 and 15 which permits engagement and disengagement of power to that station's components. The electrical enclosure 92, via program and operator dictated control parameters input at the operator station 93, is communicatively connected to various sensing and control mechanisms disposed at predetermined locations about the device 10 to synchronize and coordinate operation of these various mechanical assemblies. Such mechanisms include high and low surge detectors, for example photoeyes, limit switches, and capacitive proximity detectors, emergency stops, solenoids, motor starters, clutches, vaccum pump starters and glue shooters.

Figure 3:
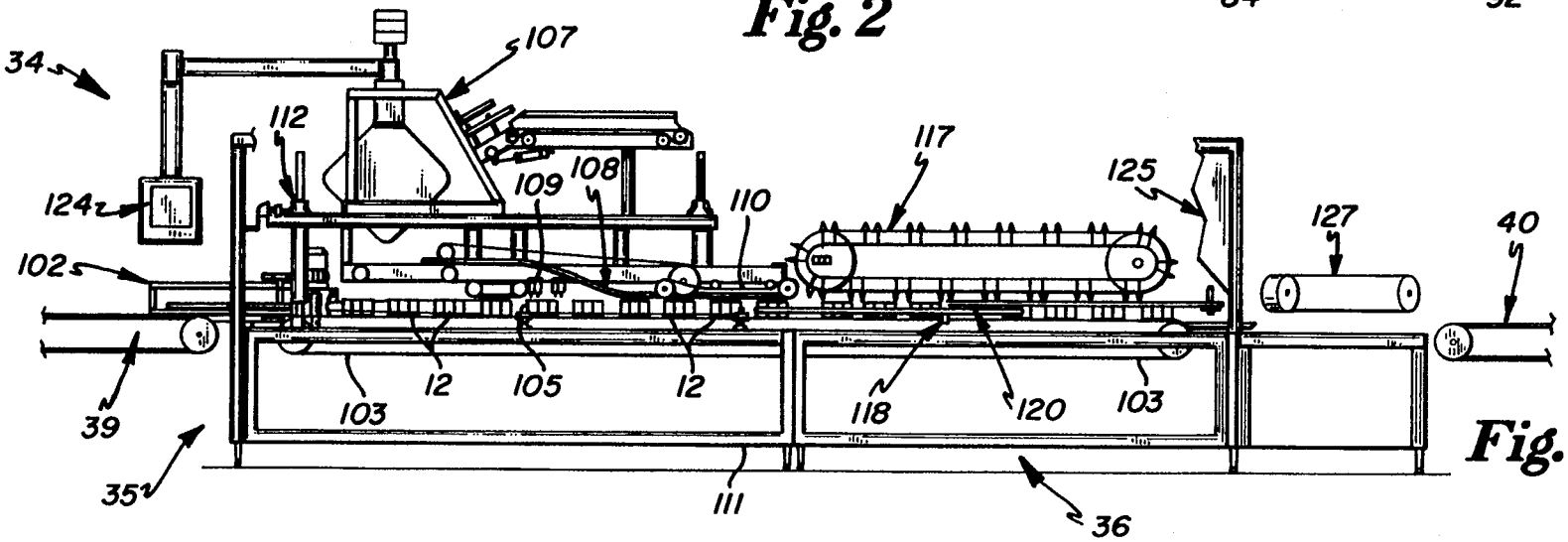
FIG. 3 is a side view of auxiliary apparatus for assembling article carriers which is used in conjunction with the apparatus of FIGS. 1 and 2.

FIGS. 3 and 4 show an auxiliary packaging apparatus 34, which when combined with the apparatus 10 as shown in FIG. 5, yields an overall packaging system 37 capable of assembling various sizes and configurations of carriers such as 8 and 12 packs. Containers 11 are received at input end 38 of apparatus 10, transferred at intermediate point 39 from apparatus 10 to apparatus 34, output at end 40 to an optional pallet orientation station 42 and finally output as a completed, properly oriented carrier 42 for shipping or further processing. The apparatus 34 is shown to align and process a pair of input 6-pack product groups into a finished 12-pack carrier. 6-pack groups arrive from apparatus 10 with only a base panel 16 connected thereto. This is accomplished at apparatus 10 by disengaging the second and third stations 14 and 15 via their respective vertically movable upper frame mechanisms 67 and 68. Hence, only the first station 13, which meters groups 12 and installs a base panel 16 thereon, is operational. Apparatus 34 aligns, deposits and secures a larger 12-pack size top/ad panel (not shown) over the base panels 16 of two side by side oriented 6-pack groups to yield a 12-pack carrier having a 3 by 4 configuration as is known in the art.

The auxiliary apparatus 34 basically comprises a single lane trans-station throughput conveyor 103, a first station 35, and a second station 36. The first station 35 comprises an infeed side transfer conveyor assembly 102, a timing screw assembly 104, a first overhead containment belt assembly 105, a second side transfer conveyor assembly 106, a combining (8/12-pack) top/ad panel rotary placer 107, a combining top/ad panel overhead transfer system 108, a glue station 109, and a second overhead containment belt assembly 110. These elements are constructed on a main frame 111. Importantly, assemblies and systems 104, 105, 107, 108, 109 and 110 are disposed on a vertically movable upper frame 112 which permits disengagement of the apparatus 34 so that the system 37 is easily convertible for 4/6-pack processing. The apparatus 34 further has an electrical enclosure 123, an operator station 124, an outer frame and guards 125, a roller based outfeed conveyor 126 and an outfeed lane divider 127.

In use, the packaging system 37, is operable in several modes to process various article group configurations and sizes, and is further adjustable to accommodate various article types and sizes. In a first mode, the system 37 is utilized to transport and meter loose container groups without assembling carriers thereon. All stations 13, 14, 15, 35 and 36 are raised via their respective upper carriages and disengaged from power via their clutch mechanisms. All glue stations are also disabled. The throughput conveyors, infeed timing screw assemblies and side transfer conveyors of each station operate to run and discharge the containers. In a second mode, a base panel 16 is applied to groups 12 in each lane 63 and 64 by the first station 13, and a combining top panel (not shown) is applied to adjacent groups 12 from each lane 63 or 64, and folded at the fourth and fifth stations 35 and 36. Stations 13, 35 and 36 are adjusted or tuned for the particular size and type of container and blanks, and engaged via their clutch mechanisms. Second and third stations 14 and 15 are raised and disabled. In a third mode, a base panel 16 and a flap-less top panel (not shown) are applied to each group 12 in the two lanes 63 and 64. The first and second stations 13 and 14 are tuned and engaged, and the third, fourth and fifth stations 15, 35 and 36 are disabled. In a fourth mode, a base panel 16 and a standard top panel 17 are applied to each group 12. The first, second and third stations 13, 14 and 15 are tuned and engaged, and the fourth and fifth stations 35 and 36 are disabled.

FIGS. 10–30 show detailed structure of the assemblies and mechanisms of the basic apparatus 10 shown in FIGS. 1 and 2. As will readily be appreciated to those skilled in the art, the structure shown in the drawing figures and the following discussion with respect to its components, component interconnection and function, are also relevant to the assemblies and mechanisms of the auxiliary apparatus 34 shown in FIGS. 3 and 4, and will enable one to make and use such apparatus 34.

Referring to FIGS. 10, 13, 16 and 17, the first station 13 infeed conveyors 49 each have a frame 133, a longitudinally oriented side transfer conveyor 50 supported by the frame 133, and a roller platform or base 51. The side transfer conveyors 50 each have a pair of spacially parallel, upstanding, counter revolving endless belts 134 which are separated a predetermined distance equivalent to the width of the respective lane or path 63 or 64 with which they are aligned. The belts 134 are preferably constructed of a flexible polymeric substance such as polyurethane, with a Kevlar reinforcing cord network. The belts 134 have a plurality of lugs or teeth 135 located on their outwardly disposed faces. The lugs 135 are shown to be spaced at a distance generally equivalent to the diameter of a standard beverage container 11 processed by the apparatus 10. The lugs 135 also preferably have a fabric backing on their curved contact faces. Each belt 134 is disposed about and continuously driven by a drive pulley (connected to a vertically oriented, axial shaft) 136 and an idler pulley (and shaft) 137. The roller platforms 51 are disposed below the side transfer conveyors 50, in-line with each lane 63 and 64, and provide a low friction support base for articles 11 being translated by the action of the side transfer conveyors 50. The infeed conveyors 49 are shown to have a length sufficient to engage approximately twenty (20) standard beverage containers 11 aligned in a side by side orientation and divided or separated a predetermined distance by center lane divider 65. The lane divider 65 is shown to be an elongated, vertically oriented plate structure which extends downstream to a point adjacent the end of the first station 13. The lane divider 65 creates a space or gap of a predetermined width between the two rows of containers traveling in each lane 63 or 64 so that the center rib 18 of the base panel 16 may be depressed thereinbetween as shown and discussed below. Containers 11 are output to the input end of the trans-station throughput conveyor 52.

The trans-station throughput conveyors 52 each comprise a pair of spacially parallel, side by side endless belts 143 and 144 which are disposed about and driven by side by side, driven sprockets (each disposed on a common, axial, transverse and horizontally oriented shaft) 14 located immediately downstream of the infeed conveyor assemblies 50, and side by side idler sprockets (with a common shaft) 142 located at the far downstream end 39 of the apparatus 10. The conveyor belts 143 and 144 have a flat, longitudinally oriented top surface which moves in a downstream direction, and upon which the containers 11 are supported and moved therewith. The belts 143 and 144 preferably have a linked structure, constructed of a rigid plastic material. The belts 143 and 144 have a width which is generally equivalent to the diameter of a container 11. A longitudinal void area or space 145 separates the belts 143 and 144. The lane dividers 65 are disposed in and above the void area 145.

The infeed timing screw assemblies 53 each comprise a pair of elongated, longitudinally oriented screw members 149 and 150. The inside and outside screw members 149 and 150 are disposed a predetermined distance above and at the sides of the lane 63 or 64 defined by the path of the throughput conveyor 52. The vertical height and horizontal separation distance of the screws 149 and 150 is adjustable to accommodate various size containers. The screws 149 and 150 are connected at their downstream ends to an axially disposed, quick release idler connector 152 and at their upstream end to an axial, quick release drive connector 151. The connectors 151 and 152 allow for easy substitution of screws for conversion from 6 to 4-pack processing. The drive connector 151 is communicatively connected to a common drive mechanism 153. The timing screw assemblies 53 run continuously and operate at a speed which is equivalent to that of the throughput conveyors 52.

The timing screw assemblies 53 receive an unmetered stream of containers 11 from the infeed conveyors 50 and in cooperation with the throughput conveyors 52, separate and meter the containers 11 into predetermined group sizes 12, 6-packs for example, as they are translated downstream. The individual screw members 149 and 150 have an elongated auger-like configuration with a differentially larger outside diameter at their downstream ends, and which creates a space or gap between trailing members of a product group 12 and the leading members of the unmetered stream, and then maintains such spacing during downstream conveyance of the now segregated container group 12. Upon output from these assemblies 53, the article groups are spaced preferably on 12 inch centers.

The first overhead containment belt assemblies 54 are disposed at the downstream ends of the infeed timing screw assemblies 53, above each lane 63 and 64. Each belt assembly 54 has an endless belt 157 which is disposed about and driven by a downstream drive pulley 158 and an upstream idler pulley 159, each pulley 158 and 159 revolving about a horizontally oriented, transverse axial shaft. The width of each belt 157 is equivalent to that of the container group 12. The planar bottom surface of each belt 157 extends a predetermined distance approximately equivalent to six (6) times the diameter of a standard container 11, and is further aligned and spaced above the throughput conveyor 52 such that it establishes frictional contact with the container 11 tops. A backing plate 160 is shown disposed to maintain downward pressure on the containers 11. The belts 157 have a width sufficient to cover the entire width of the product group 12 and are preferably constructed of a flexible material such as Linatex. The belt assemblies 54 travel at a speed which is equivalent to that of the throughput conveyors 52. The overhead containment belt assemblies 54 align the tops of each container 11 output from the timing screw assemblies 53 prior to processing downstream in the apparatus 10.

The second side transfer conveyors 55 are disposed immediately downstream with respect to the first overhead containment belt assemblies 54, and extend from the output end thereof to the end of the first station 13. Each second side transfer conveyor 55 also includes a pair of spacially parallel, upstanding counter revolving belts 163 disposed about a downstream drive pulley 164 connected to a common, vertically oriented axial drive shaft 166, and an upstream idler shaft/pulley 165, and is operative on product groups 12 traveling in a throughput lane 63 or 64. The belts 163 preferably have a structure which is similar to that of the belts 134 of the first side transfer conveyors 50. The speed of the second side transfer conveyors 55 is equivalent to that of the throughput conveyors 52. The side transfer conveyors 55 function to preserve the spacing between container groups 12 during downstream translation by the throughput conveyor 52 and processing by the remaining elements of the apparatus 10.

The base panel rotary placer 56 is shown disposed on the upper frame 67, above the infeed timing screw assemblies 53. The four apex rotary placer 56 is of a design-type such as that which is disclosed in U.S. Pat. No. 4,530,686, for Rotary Packaging Technology, assigned to Applicants' Assignee, and which is incorporated by reference herein. The rotary placer 56 continuously engages base panel blanks 16 at power magazines 170 and transports them in a flat orientation to the infeed ends of the base panel overhead transfer systems 57 which are disposed directly below the placer 56. An optional coupon placer 171 is also shown cooperatively connected to the placer 56.

Referring also to FIGS. 22–26, the base panel overhead transfer systems or carriages 57 basically comprise a support structure 180, guide rail means, a lower or proximal lug conveyor 58 and an upper or distal lug conveyor 59. The support structure 180 includes a pair of spacially parallel, longitudinally oriented bars located above the throughput conveyor 52 and which are attached to the upper frame 67. The guide rail means includes a pair of spacially parallel, longitudinally oriented bottom rails 176 and a pair of top rails 177 which are coupled to the bottom rails 176. The bottom rails 176 are disposed directly above the timing screw assemblies 53, and below the rotary placer 56 for reception of the base panel blanks 16 therefrom, and extend a predetermined downstream distance. Each bottom rail 176 further has an L-shaped crossectional configuration with an upwardly oriented vertical member and an inwardly oriented horizontal member. The bottom rails 176 are spacially separated a predetermined distance equal to the width of a blank 16, whereby the blanks 16 are deposited by the placer 56 between the vertical members, and the horizontal members support the side edges of the blank 16. The bottom rails 176 are preferably constructed of a low friction polymeric material. The rails 176 are horizontally, laterally movable so that the distance between the rails 176 is adjustable to accommodate various widths of blanks 16.

The bottom rails 176 extend longitudinally downstream in a horizontal plane for a predetermined distance and subsequently slope downwardly through a predetermined downstream distance until they are at a vertical level which is just above the top of the container groups 12. The bottom rails 176 level off horizontally at that height, extend downstream a final predetermined distance, and terminate. At their downstream end, the horizontal members of the bottom rails 176 terminate to allow the base panel blanks 16 to drop onto the synchronized, aligned moving container groups 12.

The top guide rails 177 are disposed over the bottom rails 176 such that the resulting rail pair 176–177 forms a groove in which the base panel 16 lateral edges slidingly travel. The top rails 177 begin at the end of the upstream horizontal portion of the bottom rails 176, to permit placement of the blanks 16 thereon, and extend coextensively downstream with the bottom rails 176. The top rails 177 also have a chain guide groove in which a portion of the upper lug conveyor 59 is slidingly engaged, as is discussed below. The top guide rails 177 are also preferably constructed of a plastic material.

Base panel blanks 16 are moved along the rails 176 and 177 of the overhead transfer system 57 by the lower lug conveyor 58 and the upper lug conveyor 59. The lower lug conveyor 58 is disposed generally below the upstream horizontal portion of the bottom rails 176 and longitudinally conveys blanks 16 therethrough. The lower lug conveyor 58 includes a pair of longitudinally oriented, spacially parallel endless chains 185 which are rotatably disposed on and driven by a downstream drive pulley 187 and an upstream idler pulley 188, each with a transverse and horizontally oriented shaft. The spaced chains 185 revolve and form a generally planar, downstream moving upper path between the spaced lower rails 176. The planar upper path formed by the chains 185 is flush with the level of the bottom rails 176 and extends substantially the length of the upstream horizontal portion of the bottom rails 176. A pair of elongated, spacially parallel, longitudinally oriented bottom dead plates 175 is preferably disposed between the chains 185 to provide support to the central rib portion 18 of the blanks 16 during transport. The plates 175 extend the length of the upstream horizontal portion of the bottom rails 176, and are generally coextensive with the planar upper path of chains 185. A plurality of outwardly extending trailing lugs 186 are connected to each chain 185 at intervals at least as large as the length of each blank 16 to allow for insertion of a blank 16 anterior to each lug 186 pair, the lugs 186 of each chain 185 being aligned with each other in such pairs to provide two trailing driving points for each blank 16.

The upper lug conveyor 59 is disposed generally above the downstream sloping and horizontal portions of the bottom and top guide rails 176 and 177, and longitudinally conveys blanks 16 therethrough. The upper lug conveyor 59 includes a pair of longitudinally oriented, spacially parallel endless chains 192 which are rotatably disposed in and driven by a downstream drive pulley and transverse, horizontally oriented shaft 194 and an upstream idler pulley and shaft 195. The chains 192 are spaced so that they form a lower, downstream moving path which moves in and is guided by the chain guide groove in the upper guide rails 177. A plurality of inwardly extending trailing lugs 193 are connected to each chain 192 at intervals at least as large as the length of each blank 16. The lugs 193 of the separate chains 192 are aligned in pairs. Base panel blanks 16 are transported by the lower and upper lug conveyors 58 and 59 on the overhead transfer systems 57 at the same rate as article groups 12 traveling on the throughput conveyors 52.

A base blank bias mechanism is disposed centrally between the upper lug conveyor chains 193 above the sloping portion of the bottom and top guide rails 176 and 177. The base blank bias mechanism urges the central rib portion 18 of the blanks 16 downwardly as the edges of the blanks 16 travel in the sloping groove formed between the rails 176 and 177. The bias mechanism includes an elongated, longitudinally oriented support bar 178 and approximately four flexible arms 179 which are connected to the support bar 178 at a top end and extend downwardly therefrom at an angle for contact with the blanks 16 at their opposite end.

The second overhead containment belt assemblies 60 are disposed immediately adjacent the downstream end of their respective base panel overhead transfer systems 57, and above each lane 63 and 64. Each assembly 60 has an endless flexible belt 199 which is disposed about and driven by a downstream drive pulley 200, roller guides 202, and an upstream idler pulley 201, each pulley 200 and 201 being coupled to a horizontally oriented, transverse axial shaft. The planar bottom surface of the belt 199 has a width which is slightly less than that of the base panel 16 to allow the panel side strips 19 to be exposed for contact with the outside chime locking wheel assemblies 61. The belt 199 bottom surface is adjustably spaced above the throughput conveyor 52 so that it contacts the top surface of the base panel 16, and travels at a rate equivalent to the throughput conveyor 52.

The outside chime locking wheel assemblies 61 are disposed at the downstream level of the second overhead containment belt assembly 60 output ends. The assemblies 61 have a transverse, horizontally disposed common drive shaft 207 which is disposed above the level of the throughput conveyor 52. A freewheel, non-driven shaft 207 may alternatively be utilized, wherein the assembly 61 rotates via the action of the conveyed article groups 12. A pair of wheel hubs 206 are attached to the shaft 207 adjacent each throughput lane 63 and 64, one hub 206 being placed at each side of and above each lane 63 or 64. The flat plane of each hub 206 is vertically and longitudinally oriented. Each hub 206 has a peripheral wheel rim 208. The wheel rims are preferably constructed of flexible polyurethane and have a pair of opposing flat edges (not shown). The outside diameter of the wheel rims 208, the height of the drive shaft 207 above the conveyor 52, and the spacing of the hubs 206 thereon are such that the rim 208 periphery urges the base panel side strips 19 downwardly during longitudinal transport so that the curved slits 21 engage the outwardly facing portions of the top circumferential rims or chimes of the containers 11 in groups 12.

The inside chime locking wheel assemblies 62 are disposed slightly downstream of the second overhead containment belt assemblies 60. The assemblies 62 have a transverse, horizontally disposed common drive shaft 214 (driven or non-driven) disposed above the throughput conveyor 52. A wheel hub 213 is attached to the drive shaft 214, centered above each lane 63 and 64. The flat plane of each hub 213 is vertically and longitudinally oriented. Each hub 213 has a peripheral wheel rim 215, which is preferably constructed of stainless steel or the like and has a circumferential groove therein. A urethane O-ring (not shown) is disposed in the groove. The outside diameter of the wheel rims 215 and the height of the drive shaft 214 above the conveyor 52 are such that the rim 215 periphery urges the base panel center rib 18 downwardly so that the curved slits 21 engage the inwardly facing portions of the top circumferential chimes of the containers 11 in groups 12.

As was previously mentioned, the timing screw assemblies 53, the first overhead containment belt assemblies 54, the base panel rotary placer 56, the base panel overhead transfer system 57, the second overhead containment belt assemblies 60 and the outside and inside chime locking wheel assemblies 61 and 62 are all disposed on an upper frame structure 67 to provide adjustability and/or convertibility of packaging. The upper frame 67 includes a network of spaced and connecting horizontal members 219 which are connected to adjustable jacks 220 located at four corner positions of the first station 13. The jacks 220 have vertically disposed cylindrical posts 221 which are mounted at their bottom ends to the main frame 66 via post mounts 227, cylindrical hollow sleeves 222 which ride on the posts 221 and drive gears 223. A hand crank 224 is connected to one of the drive gears 223. The drive gears 223 are shown to be communicatively connected by synchronizing drive chains 225 and shafts 226 so that all four jacks 220 may be simultaneously operated from the single crank 224.

In summary, the first station 13 processes a pair of unmetered streams of articles 11 into two streams of predetermined groups 12 retained by base panels 16. The infeed conveyors 49 uniformly feed containers 11 to the product paths 63 and 64 and further form a gap between the two rows of containers 11 forming each path 63 or 64. The throughput conveyors 52 receive containers 11 from the infeed conveyor assemblies 49 and subsequently have primary responsibility for transporting them in the conveyance paths 63 and 64 throughout the remainder of the first station 13, as well as through the second and third stations 14 and 15. The infeed timing screw assemblies 53 separate the streams of containers into predetermined groups 12. Article groups 12 conveyed in lanes 63 and 64 emerge immediately downstream of the first overhead containment belt assemblies 54 in a condition for engagement with the base panels 16. They have a level top surface and a slight longitudinally oriented central gap between the two rows of three containers 11. As each group 12 is conveyed in a stable, spaced orientation by the throughput conveyors 52 and the second side transfer conveyors 55 it is aligned with a base panel 16 traveling above it on an overhead transfer system 57. At the downstream horizontal portion of each system 57, a synchronized base panel 16 is deposited on the top surface of a group 12. They are then conveyed under the second overhead containment belt assemblies 60 where pressure is exerted on the top of the base panel 16 to hold it in position on the container group 12. At the downstream end of the second overhead containment belt assemblies 60, the strips 19 of each panel 16 are locked down on the container group 12 by the outside chime locking wheel assemblies 61, while the group 12 is still under the control of a containment belt assembly 60. And subsequently, the central rib 18 of the panel 16 is locked down by the inside chime locking wheel assemblies 62, prior to output from the first station 13.

FIGS. 11, 14, 18 and 19 show the second station 14 generally comprising side transfer conveyors 71 (3rd), the top/ad panel rotary placer 72, top/ad panel overhead transfer mechanisms 73, overhead containment belt assemblies 76 (3rd), and glue stations 77. The side transfer conveyors 71 cooperate with the throughput conveyors 52 to receive spaced, metered article groups (with the engaged carrier base panels 16) from the first station 13 and to transport them in such spaced orientation through the second station 14. The remaining elements are disposed on an adjustable upper frame 80 and function to align and engage container top/ad panels 17 with the moving product groups 12, at the top surface (base panel 16) thereof. The vertically movable frame 80 also allows second station 16 processing to be disengaged for 8/12 pack construction as was previously discussed. A glue supply cart 78, preferably a Nordson Model No. 3966, is shown communicatively coupled to the glue stations 77.

The third side transfer conveyors 71 are disposed immediately downstream with respect to the second side transfer conveyors 55 and extend from the output end thereof to the end of the second station 14. Each third side transfer conveyor 71 also includes a pair of spacially parallel, upstanding counter revolving belts 301 disposed about a downstream drive pulley 302 connected to common drive shaft 166, and an upstream idler shaft/pulley 303, and is operative on product groups 12 traveling in one throughput lane 63 or 64. The speed of the third side transfer conveyors 71 is equivalent to that of the throughput conveyor 52.

The top or ad panel rotary placer 72 is shown disposed on the upper frame 80, above the top panel overhead transfer system 73. The rotary placer 72 is also of a design-type such as that which is disclosed in U.S. Pat. No. 4,530,686.

The top panel overhead transfer systems 73 basically comprise a support structure 307, guide rail means, a lower or proximal lug conveyor 74 and an upper or distal lug conveyor 75. The support structure 307 includes a pair of spacially parallel, longitudinally oriented bars located above the throughput conveyor 52 and which are attached to the upper frame 80. The guide rail means includes a pair of spacially parallel, longitudinally oriented bottom rails 310 and a pair of top rails 311 which are connected to the bottom rails 310. The bottom rails 310 are disposed directly above the throughput conveyor 52, and below the rotary placer 72 for reception of the top panel blanks 17 therefrom, and extend a predetermined downstream distance. The bottom rails 310 are spacially separated a predetermined distance equal to the width of a blank 17, whereby the blanks 17 are deposited by the placer 72 between the rails 310. The rails 310 are horizontally, laterally movable so that the distance between them is adjustable to accommodate various sizes (widths) of blanks 17.

The bottom rails 310 extend longitudinally downstream in a horizontal plane for a predetermined distance, subsequently slope downwardly through a predetermined downstream distance until they are at a vertical level which is just above the vertical top of the container groups 12, then level off (horizontally) at that height and extend a final predetermined distance, and terminate. At their downstream end, the rails 310 are open at the bottom to allow the top panel blanks 17 to drop onto the moving container groups 12.

The top guide rails 311 are disposed over the bottom rails 310 such that the rail pair 310–311 forms a groove in which the top panel 17 lateral edges slidingly travel. The top rails 311 begin at the end of the upstream horizontal portion of the bottom rails 310, to permit placement of the blanks 17 thereon, and extend coextensively downstream with the bottom rails 310. The top rails 311 also have a chain guide groove (not shown) in which a portion of the upper lug conveyor 75 is slidingly engaged.

Top panel blanks 17 are moved along the rails 310 and 311 of the overhead transfer system 73 by the lower lug conveyor 74 and the upper lug conveyor 75. The lower lug conveyor 74 is disposed substantially below the upstream horizontal portion of the bottom rails 310 and longitudinally conveys blanks 17 therethrough. The lower lug conveyor 74 includes a pair of longitudinally oriented, spacially parallel, endless spaced chains 312, a downstream drive pulley/shaft 313 and an upstream idler pulley/shaft 314. The chains 312 form a generally planar, downstream moving upper path between the spaced lower rails 310 which is flush with the level of the rails 310 and extends substantially the length of the upstream horizontal portion of the bottom rails 310. A pair of elongated, spacially parallel, longitudinally oriented bottom dead plates 315 is preferably disposed between the chains 312 to provide support to the central portion of the blanks 17 during transport. The plates 315 extend the length of the upstream horizontal portion of the bottom rails 310, and are generally coextensive with the planar upper path of chains 312. A plurality of outwardly extending trailing lugs 316 are connected to each chain 312 at intervals at least as large as the length of each blank 17.

The upper lug conveyor 75 is disposed substantially above the downstream sloping and horizontal portions of the bottom and top guide rails 310 and 311, and longitudinally conveys blanks 17 therethrough. The upper lug conveyor 75 includes a pair of longitudinally oriented, spacially parallel, endless chains 317, a downstream drive pulley/shaft 318, and an upstream idler pulley/shaft 319. The chains 317 form a lower, downstream moving path which moves in and is guided by the chain guide groove in the upper guide rails 75. A plurality of inwardly extending trailing lugs 320 are connected to each chain 317 at intervals at least as large as the length of a blank 17. A bias mechanism is disposed centrally between the chains 317 above the sloping portion of the bottom and top guide rails 310 and 311. The bias mechanism urges the central portion of the blanks 17 downwardly as the edges of the blanks 17 travel in the sloping groove formed between the rails 310 and 311. The bias mechanism includes an elongated, longitudinally oriented support bar 321 and approximately four flexible arms 322.

The overhead containment belt assemblies 76 are disposed immediately adjacent the downstream end of their respective top panel overhead transfer systems 73, and above each lane 63 and 64. Each assembly 76 has an endless flexible belt 326 which is disposed about and driven by a downstream drive pulley 327, roller guides 328, and an upstream idler pulley 329, each pulley 327 and 329 being coupled to a horizontally oriented, transverse axial shaft. The planar bottom surface of the belt 326 has a width which is generally equivalent to that of the top panel 17 top surface 22. The belt 326 bottom surface is adjustably spaced above the throughput conveyor 52 so that it contacts the top surface of the top panel 17, and travels at a rate equivalent to that of the throughput conveyors 52.

The top panel rotary placer 72, the top panel overhead transfer system 79, the glue stations 77 and overhead containment belt assemblies 76 are all disposed on the upper frame structure 80 to provide adjustability and convertibility. The upper frame 80 includes a network of spaced and connecting horizontal members 333 which are connected to adjustable jacks 334 located at four corner locations. The jacks 334 are mounted at their bottom ends to the main frame 66. A hand crank 335 is connected to drive gears 336 which operate the jacks 334. The drive gears 336 are shown to be connected by synchronizing means.

In summary, article groups 12 conveyed in lanes 63 and 64 emerge immediately downstream of the first station 13 in a condition for engagement with the top panels 17. They are separated into groups and have a level base panel 16 top surface. In the second station 14, each group 12 is conveyed in a stable orientation by the throughput conveyors 52 and the third side transfer conveyors 71. Glue is next deposited at predetermined locations on the top surface of each base panel 16 by an overhead glue station 77. Each product group 12 is then aligned with a top/ad panel 17 traveling above it on the overhead transfer systems 73. At the downstream horizontal portion of the systems 73, the synchronized top panel 17 is deposited on the top surface of the base panel 16. They are then conveyed under the overhead containment belt assemblies 76 where pressure is exerted on the top of the top panel 17 to hold it in a glued position on the base panel group 16. Article groups 12 are then normally output from the second station 14 to the third station 15 to undergo flap tucking.

As shown in FIGS. 12, 15, 20, 21, 27 and 28 the third station 15 generally comprises side transfer conveyors 84 (4th), an overhead ad panel flap tucking mechanism 85, glue stations 86, flap compression belt assemblies 87 and outfeed base rollers 88. A glue supply cart, such as a Nordson Model No. 3400, is preferably connected to the glue stations 86. These station 15 elements operate on the flaps of the top/ad panel 17 (the panel 17 previously having been adhesively mated to the top surface of the base panel 16 at second station 14) to yield a folded, completed carrier unit. These station 15 elements are shown to be disposed on the upper frame 90, which is vertically, adjustably mounted to base frame 89 via jacks for adjustment and apparatus 10 conversion purposes.

The fourth side transfer conveyors 84 are disposed immediately downstream with respect to the second station 14 and extend from the output end thereof to an upstream portion of the flap compression belt assemblies 87. Each side transfer conveyor 84 also includes a pair of spacially parallel, upstanding counter revolving belts 233 disposed about a downstream drive pulley 234 connected to a drive shaft, and an upstream idler shaft/pulley 235, and is operative on product groups traveling in a throughput lane 63 or 64. The speed of the side transfer conveyors 84 is equivalent to that of the conveyor 52.

The overhead ad panel flap tucking mechanism 85 generally comprises a frame 239 having horizontal and vertical members and which is attached to the upper frame 90, downstream drive sprocket pairs 240 mounted on a transverse, horizontally oriented common drive shaft, upstream idler sprockets 241 and an associated shaft, endless flight chain pairs 242 coupled with and longitudinally rotating on the sprockets 240 and 241, and a plurality of pairs of spaced leading and trailing flights 243 and 244 which are coupled with the chains 242. The flap tucker 85 further comprises a flight control cam system with first horizontal control tracks 245, second vertical control tracks 246, and a third finger control track 247. The flap tucker 85 further comprises a flap plow 248.

The drive and idler sprocket pair sets 240 and 241 are disposed at opposite longitudinally spaced ends of the frame 239 and are oriented above and in a plane which extends vertically and longitudinally with respect to the product lanes 63 and 64. The longitudinally oriented, spacially parallel inner and outer chain pairs 242 are rotatably disposed on the sprockets 240 and 241. The chains 242 form a pair of spacially parallel, planar downstream moving actuation paths at the bottom of the assembly 85, which are oriented above the respective product conveyance paths 63 and 64, and extend a predetermined distance, overlapping the location of the side transfer conveyors 84 and an upstream portion of the flap compression belt assemblies 87. The leading and trailing flights 243 and 244 travel along the actuation paths and engage the product groups 12 traveling on the throughput conveyor 52 for flap folding.

The first flight control cam tracks 245 are elongated, planar, spacially parallel track structures which are longitudinally oriented above the assembly 85 actuation paths. The tracks 245 extend from approximately the idler sprockets 241 to the drive sprocket 240. The first flight control cam tracks 245 mate with cam followers of the leading and trailing flights 243 and 244 and control the horizontal plane of travel of a portion of the flights 243 and 244 along the assembly 85 actuation paths. The second flight control cam tracks 246 are elongated, spacially parallel tracks which are longitudinally oriented above the first flight control cam tracks 245. The tracks 246 extend from a point slightly downstream of the first track 245 input ends to a point slightly upstream of the first track 245 output ends. The second flight control cam tracks 246 are continuous structures, each having a downwardly sloping or plunging segment located at its upstream end, an elongated horizontal dwell segment extending a predetermined distance therefrom, and an upwardly sloping or rising segment disposed at its downstream end. The second flight control cam tracks 246 mate with particular cam followers of the leading and trailing flights 243 and 244, and control the vertical movement of a particular portion of the flights 243 and 244 along the assembly 85 actuation paths. The third flight control cam tracks 247 are elongated plate-like structures which are horizontally, and longitudinally oriented above the second flight control cam tracks 246. The length of each track 247 is substantially coextensive with that of the second flight control cam track 246. The third flight control cam track 247 is a continuous structure having an input segment located at its upstream end, an outwardly sloping segment located immediately downstream therefrom, a dwell segment extending downstream from the outwardly sloping segment, an inwardly sloping segment extending therefrom, and an output segment located at its downstream end. The third flight control cam track 247 communicatively couples with particular cam followers of the trailing flights 244, and controls the rotational movement of particular structures on the flights 244 along the assembly 85 actuation paths. The flap plows 248 are generally centrally disposed along the bottom of the overhead ad panel flap tucking assembly 85, above and adjacent the sides of the product paths 63 and 64. They are further oriented upstream of the input end of the flap compression belt assemblies 87 and cooperate with the flights 243 and 244, to fold and secure the top panel 17 flaps as will be discussed in detail below.

The flap compression belt assemblies 87 generally comprises first, upstream belts 253, second, middle belts 254 and third downstream belts 255 which are shown interconnectedly disposed about first, second, third and fourth pulleys 256–259. A drive shaft 260 located at the downstream end of the assemblies 87 provides power thereto. The belts 253–255 are shown disposed above the throughput conveyors 52, at different levels, and adjacent the sides of the conveyance paths 63 and 64. Each belt has an inwardly and longitudinally disposed planar travel segment, overlapping with a portion of its immediate neighbor, which extends a predetermined downstream distance for compression of the folded flaps. The second or middle belts 254 are disposed slightly below the first and third belts 253 and 255, whereby a predetermined panel flap region is momentarily freed from compression for release of the trailing flight therefrom, as is discussed below.

Figure 29:
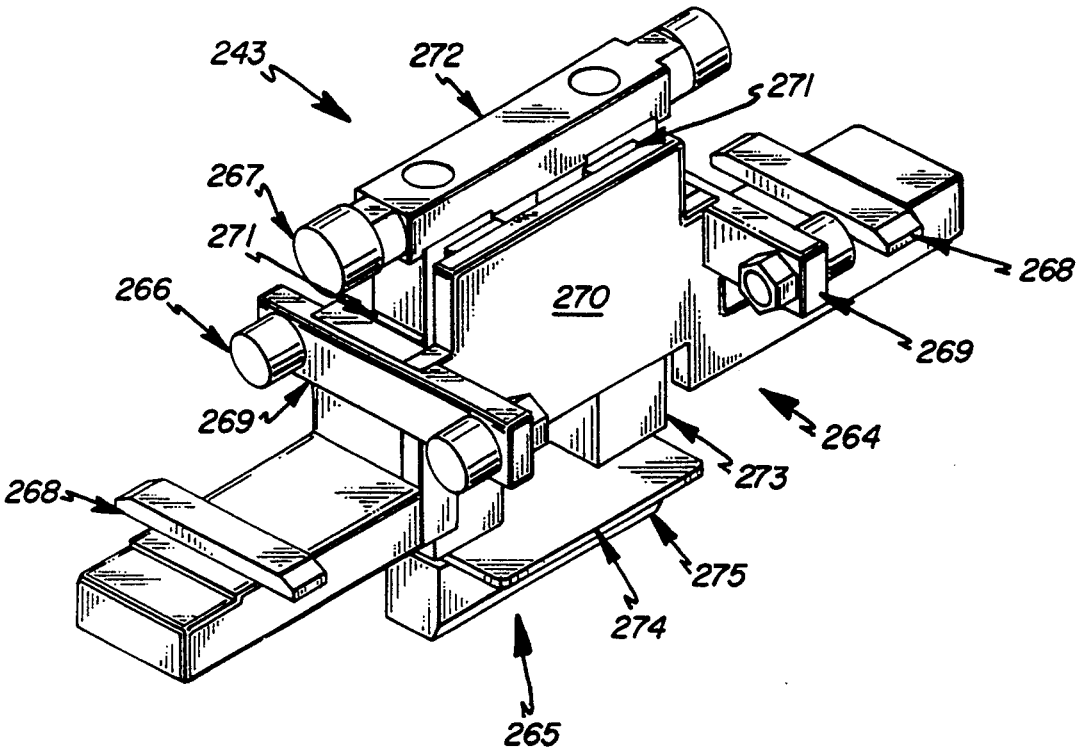
FIG. 29 is a perspective view of a leading flight member of the station 3 apparatus.

Referring also to FIG. 29, the leading flights 243 are shown to have a flight housing 264 and a flight block 265 which is vertically movably coupled to the housing 264. The flight housing 264 includes a face plate 270 forming a central cavity in the housing 264, and several vertical bearings 271 disposed in the cavity for sliding contact with the flight block 265. Chain support structures 268 extend laterally from the sides of the housing 264. Two housing control cam followers 266 are attached to each lateral side of the housing 264, above the chain supports 268, via rectangular bearing blocks 269. The flight block 265 consists of two spaced rectangular blocks 273 which are disposed in the housing 264 cavity and connected at their top ends via a bearing block 272. A block control cam follower 267 is rotatably coupled to each end of the rectangular bearing block 272. A generally flat, thin hold down plate 274 and a forming flight member 275 are disposed at the opposite end of the flight blocks 273. The flight housing 264 rides at a predetermined, adjustable location on the tucking mechanism 85 chains 242 via the chain supports 268. The chain supports 268 are coupled to the outer chain pairs. Adjustment of the outer chain pair with respect to the stationary inner chain pair affects a change in the phase or separation distance between the leading and trailing flights 243 and 244. This allows convertability of flap tucking mechanism 85 use in various panel 17 sizes, as well as adjustability for producing tight carrier configurations. The vertical position of the flight housing 264 as it travels along the assembly 85 actuation path is maintained at a constant level by the housing control cam followers 266 which travel in and are communicatively coupled to the first cam track 245. The vertical position of the flight block 265 with respect to the flight housing 264 is controlled by the block control cam followers 267 which travel in and are communicatively coupled to the second cam track 246. The hold down plate 274 and the forming flight member 275 contact and downwardly fold the leading end flap 24 of the top panel 17 when the flight block 265 lowers at a predetermined longitudinal position of travel.

Figure 30:
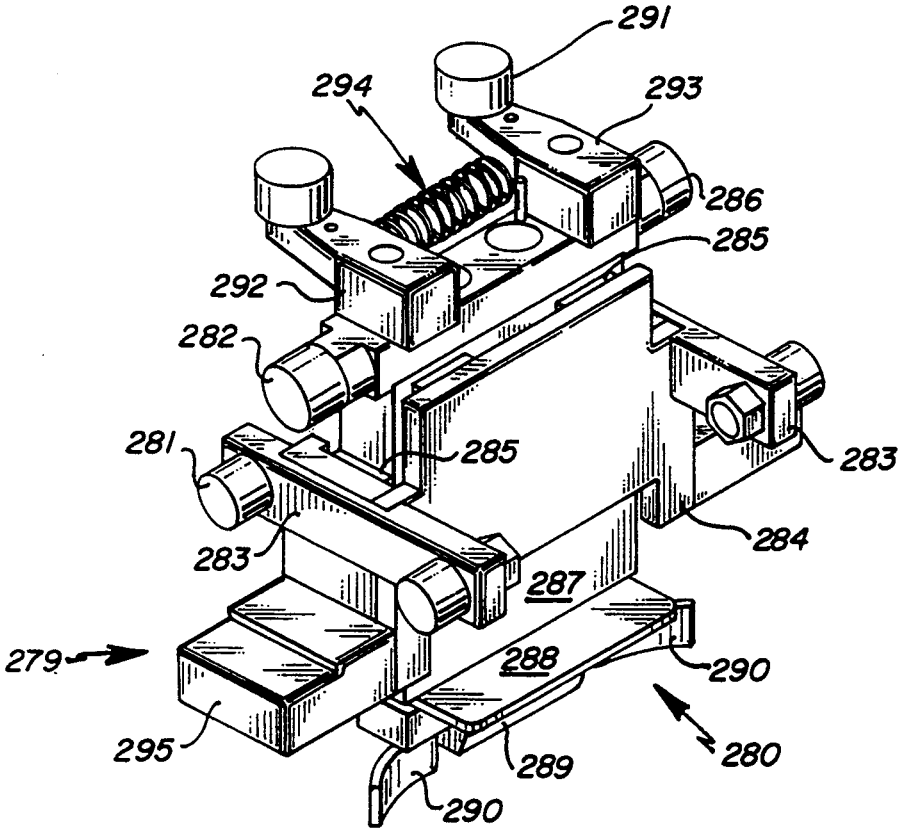
FIG. 30 is a perspective view of a trailing flight member of the station 3 apparatus.

Referring also to FIG. 30, the trailing flights 244 are shown to have a flight housing 279 and a flight block 280 which is vertically movably coupled to the housing 279. The flight housing 279 includes a face plate 284 forming a central cavity in the housing 279, and several vertical bearings 285 disposed in the cavity for sliding contact with the flight block 280. Chain support structures 295 extend laterally from the sides of the housing 279. Two housing control cam followers 281 are attached to each lateral side of the housing 279, above the chain supports 295, via rectangular bearing blocks 283. The flight block 280 consists of a rectangular block 287 which is disposed in the housing 279 cavity and connected to a bearing block 286. A block control cam follower 282 is rotatably coupled to each end of the rectangular bearing block 286. A generally flat, thin hold down plate 288 and a forming flight member 289 are disposed at the opposite end of the flight block 287. A pair of curved tucking fingers 290 are disposed on the bottom edge of the flight block 287, adjacent opposing ends of the forming flight 289. The fingers 290 are attached to shafts 293 which extend vertically through the flight block 287 and the bearing block 286. A roller arm 292 is connected to the top end of each shaft 293 at a first end thereof. Finger control cam followers 291 are rotatably coupled to the roller arms 292 at a second opposing end thereof. The cam followers 291 are rotatable about an axial shaft which is oriented spacially parallel with respect to the shafts 293, whereby movement in a plane which is horizontally oriented with respect to the trailing flight 244 causes the shaft 293 to rotate, via arms 292, which actuates the fingers 290. A return or reset spring 294 is connected to each arm 292 so that an outward or spreading change in arm 292 position caused by cam track input end 247 is reset when the spreading force (due to the cam track 247 end output shape) is removed.

The flight housing 279 is coupled to a predetermined location on the tucking mechanism 85 chains 242 via the chain supports 295. The chain supports 295 are connected to the inner chain pair. The vertical position of each flight housing 279 as it travels along an assembly 85 actuation path is maintained at a constant level by the housing control cam followers 281 which travel in and are communicatively coupled to travel in the first cam track 245. The vertical position of the flight block 280 with respect to the flight housing 279 is controlled by the block control cam followers 282 which travel in and are communicatively coupled to the second cam track 246. The hold down plate 288 and the forming flight member 289 contact and downwardly fold the trailing end flap 24 of the top panel 17 when the flight block 280 lowers at a predetermined position of travel for the article group 12. The tucking fingers 290 rotate inwardly at a predetermined position along the assembly 85 actuation path as a result of the communicative coupling between the finger control cam followers 291 and the third cam track 247. The inwardly rotated fingers 290 contact and urge inwardly the minor flaps or tabs 27 of the trailing end flap 24, causing them to fold. This occurs at approximately the same time as the tabs 27 of the leading end flap 24 are folded inwardly by the flap plow 248, and prior to the side flaps 23 being folded downwardly, also by the flap plow 248.

In summary, the third station 15 receives two streams of article groups 12, each group having an engaged base panel 16 and glued top panel 17 disposed thereon, and glues and folds the flaps of the top panel 17 to yield completed 6-pack carriers. The spaced article groups 12 traveling on the conveyance paths 63 and 64 are aligned below a leading flight 243 and a trailing flight 244 of the flap tucking mechanism 85. The flight blocks 265 and 280 of the leading and trailing flights 243 and 244 are lowered onto and depress the leading and trailing end flaps 24 of the top panel 17. Subsequently the flap plows 248 begin to inwardly fold the tabs 27 of the leading end flap 24, and the tucking fingers 290 of the trailing flight 244 begin to inwardly fold the tabs 27 of the trailing end flap 24. At this point, the tabs 27 are translated by the glue station 86, wherein a predetermined amount of adhesive is applied thereto. Continued translation of the panel 17 by the flap plows 248 results in fully tucked tabs 27 and in tucking of the side flaps 23 over the adhesive coated tabs 27. Also, continued downstream translation of the trailing flights 244 causes the tabs 27 of the trailing end flaps 24 to be fully folded prior to the folding of the side flaps 23. Downstream translation of the article groups 12 brings the folded side flaps 23 into compressive engagement with the upstream belts 253, middle belts 254 and downstream belts 255, consecutively, of the belt assembly 87. Because the middle belts 254 are disposed at a relatively low level, side compression is momentarily released at the panel 17 side areas where the tucking fingers 290 of the trailing flights 244 are disposed below the panel side flaps. At this point, the fingers 290 deactivate and rotate outwardly from behind the side flaps 23. Simultaneously, the leading and trailing flights 243 and 244 rise and release contact with the end flaps 24. Compression is maintained on the side flaps 23 by the downstream belts 255 for an additional period of time to allow further adhesive curing prior to output.

As many changes are possible to the embodiments of this invention utilizing the teachings thereof, the descriptions above, and the accompanying drawings should be interpreted in the illustrative and not the limited sense.

That which is claimed is:

1. An apparatus for assembling clip-type article carriers, comprising:

a) means to input at least one metered, linear stream of article groups;

b) a conveyor assembly constructed and arranged to receive said at least one stream of article groups from said input means and longitudinally translate said groups in a downstream conveyance path;

c) an overhead transfer mechanism constructed and arranged above said conveyor assembly to deposit a clip-type article carrier onto a top surface of at least one said article group, said overhead transfer mechanism having a first end disposed at a first height above said conveyor assembly and a second end located downstream with respect to said first end and at a second lower height above said conveyor assembly, means to supply carrier blanks at said first end, a pair of spatially parallel tracks separated a predetermined distance, a first conveyance section having at least one driven lugged chain disposed and operative along a first predetermined segment of said tracks, and a second conveyance section having at least one driven lugged chain disposed and operative along a second predetermined segment of said tracks; and d) means to bring said clip-type article carrier into mating engagement with said top surface of at least one said article group.

2. The apparatus of claim 1, wherein said input means comprises a pair of longitudinally oriented generally spacially parallel screw structures which are separated a predetermined distance and disposed above said conveyor assembly.

3. The apparatus of claim 2, wherein said input means further comprises a side transfer conveyor assembly disposed upstream with respect to said screw structures.

4. The apparatus of claim 1, wherein said conveyor assembly comprises at least one endless belt structure having a longitudinally oriented top surface defining said conveyance path for support of a bottom surface of said article groups.

5. The apparatus of claim 4, wherein said conveyor assembly further comprises at least one second side transfer conveyor assembly for maintaining the metered position of article groups in said stream of article groups translated by said conveyor assembly, said at least one side transfer conveyor being constructed and arranged so that it is operative over a downstream distance coextensive with respect to said endless belt structure top surface.

6. The apparatus of claim 1, wherein said supply means consists of a rotary placer apparatus and a magazine, said rotary placer apparatus continuously transferring carriers from said magazine disposed at a first position to said guide means first end disposed at a second position below said first position.

7. The apparatus of claim 1, wherein said overhead transfer mechanism further comprises means to downwardly bias said carrier at said second end of said guide means.

8. The apparatus of claim 1, wherein said overhead transfer mechanism and said engagement means are supported on a frame structure which is vertically movable with respect to said input means and said conveyor assembly, whereby said overhead transfer mechanism and said engagement means is removable from operation on article groups translated by said conveyor assembly.

9. The apparatus of claim 1, wherein:

i) said clip type article carriers include a base member having a predetermined slotted engagement pattern for mating with a top surface of said article groups;

ii) said input means comprises a pair of longitudinally oriented generally spacially parallel screw structures which are separated a predetermined distance and disposed above said conveyor assembly, and a side transfer conveyor assembly disposed upstream with respect to said screw structures; and iii) said engagement means comprises an overhead containment assembly constructed and arranged above said conveyor assembly downstream from said overhead transfer mechanism, said overhead containment assembly including at least one endless belt having a longitudinally oriented bottom surface for contact with a top surface of said article groups, said engagement means further comprising at least one disc-shaped, rotatable plow for urging said carrier base member slotted engagement pattern into mating engagement with the top surface of said articles.

10. The apparatus of claim 1, wherein:

i) said clip-type article carriers including at least one base member having a predetermined slotted engagement pattern mated with a top surface of the article group, and a top member disposed on said base member and having a substantially flat top portion, and a plurality of foldable flap portions disposed about the periphery of said top portion;

ii) said input means comprises a side transfer conveyor assembly having a first end disposed upstream with respect to said conveyor assembly; and iii) said engagement means comprises an overhead containment assembly constructed and arranged above said conveyor assembly downstream from said overhead transfer mechanism, said overhead containment assembly including at least one endless belt having a longitudinally oriented bottom surface for contact with a top surface of said article groups, said engagement means further comprising means to deposit an adhesive substance at a predetermined orientation on the top surface of said base member, said adhesive deposit means being disposed upstream with respect to said overhead transfer mechanism, and said engagement means further comprising means to fold said carrier flap portions in a predetermined order, said flap folding means being disposed downstream with respect to said overhead containment assembly.

11. The apparatus of claim 1, wherein said engagement means comprises an overhead containment assembly constructed and arranged above said conveyor assembly, downstream from said overhead transfer mechanism, said overhead containment assembly including at least one endless belt having a longitudinally oriented bottom surface for contact with a top surface of said article groups.

12. The apparatus of claim 11, wherein each said clip-type article carrier includes a base member having a predetermined slotted engagement pattern for mating with a top surface of one said article group, and wherein said engagement means further comprises at least one disc-shaped, rotatable plow for urging said slotted engagement pattern into mating engagement with the top surface of said article group.

13. The apparatus of claim 12, wherein each said carrier further includes a top member and wherein said apparatus further comprises means to provide one said top member in mating engagement over each said base member engaging a respective said article group.

14. The apparatus of claim 12, wherein each said carrier further includes a top member and wherein said apparatus further comprises means to provide one said top member over two said base members.

15. The apparatus of claim 11, wherein each said clip-type article carrier includes at least one base member having a predetermined slotted engagement pattern mated with a top surface of the article group, and a top member disposed on said base member and having a substantially flat central portion, and a plurality of foldable flap portions disposed about the periphery of said top portion, and wherein said engagement means further comprises means to deposit an adhesive substance at a predetermined orientation on the top surface of said base member, said adhesive deposit means being disposed upstream with respect to said overhead transfer mechanism.

16. The apparatus of claim 15, wherein said engagement means further comprises means to fold said carrier flap portions in a predetermined order, said flap folding means being disposed downstream with respect to said overhead containment assembly.

17. The apparatus of claim 16, wherein said flap folding means comprises at least one third side transfer conveyor disposed above and to the sides of said conveyor assembly, a cam actuated rotary overhead top panel flap tucking mechanism constructed and arranged above and longitudinally with respect to said conveyor assembly, and a flap compression belt assembly disposed above and to the sides of said conveyor assembly.

18. The apparatus of claim 17, wherein said flap tucking mechanism comprises a frame disposed over said conveyor assembly, at least one drive sprocket rotatably connected to one end of said frame, at least one idler sprocket rotatably connected to an opposite end of said frame, at least one endless chain means disposed about said drive and idler sprockets, said chain forming a bottom downstream actuation path aligned over said conveyor assembly, a plurality of leading flights disposed at spaced intervals on said chain means corresponding to said metered article group stream, a plurality of trailing flights disposed on said chain means, each a predetermined, adjustable distance from a respective said leading flight, said leading and trailing flights having actuatable means to engage and fold a predetermined portion of said top members, and at least one cam means to actuate said means to engage and fold.

19. The apparatus of claim 18, wherein said compression belt assembly comprises at least two belt pairs disposed and operative along predetermined, consecutive longitudinal segments of said conveyance path, a first belt pair being disposed along opposing sides of and above said conveyance path at a first vertical level, and a second belt pair being disposed along opposing sides of and above said conveyance path at a second vertical level which is lower than said first vertical level.

20. The apparatus of claim 1, wherein:

i) said clip-type article carriers consist of a base member having a predetermined slotted engagement pattern for mating with a top surface of said article groups and a top member having a substantially flat central portion and a plurality of flap portions;

ii) said input means inputs two spacially parallel, synchronized streams of article groups;

iii) said overhead transfer mechanism deposits said base member on said top surface of one said article group and said engagement means mates said base member to said top surface of said one article group; and iv) said apparatus further comprises:

i') a second overhead transfer mechanism constructed and arranged above said conveyor assembly to deposit one said top member onto a top surface of at least one said base member; and ii') means to bring said top member into mating engagement with said top surface of said at least one base member.

21. The apparatus of claim 20, wherein said second overhead transfer mechanism deposits one said top member onto a top surface of two adjacent base members and said engagement means brings said top member into mating engagement with said two base members.

22. An apparatus for assembling two-pan clip-type article carriers consisting of a base member and a top member, comprising:

a) means to input at least one metered, linear stream of article groups;

b) a conveyor assembly constructed and arranged to receive said at least one stream of article groups from said input means and longitudinally translate said groups a predetermined downstream distance at a predetermined rate;

c) an overhead transfer mechanism constructed and arranged above said conveyor assembly to deposit base members onto a top surface of at least one said article group;

d) at least one second overhead transfer mechanism constructed and arranged downstream of said overhead transfer mechanism and above said conveyor assembly to deposit said top members onto a top surface of at least one said base member and e) a cam actuated rotary overhead top member flap tucking mechanism disposed above said conveyor assembly.

23. An apparatus for assembling two-part clip-type article carriers consisting of a base member having a predetermined slotted engagement pattern for mating with a top surface of article groups and a top member having a substantially flat central portion and a plurality of flap portions, comprising:

a) means to input at least one metered, linear stream of article groups;

b) a conveyor assembly constructed and arranged to receive said at least one stream of article groups from said input means and longitudinally translate said groups a predetermined downstream distance at a predetermined rate;

c) a first convertible, adjustable overhead station for processing said base members, said first station comprising:

i) an overhead transfer mechanism constructed and arranged above said conveyor assembly to deposit base members onto a top surface of at least one said article group; and ii) means to bring said base members into mating engagement with said top surface of said at least one article group; and at least one second convertible adjustable overhead station disposed downstream with respect to said first station for processing said top members, said second station comprising:

i) an overhead transfer mechanism constructed and arranged above said conveyor assembly to deposit said top members onto a top surface of at least one said base member; and ii) top member flap folding means having a cam actuated rotary overhead top panel flap tucking mechanism constructed and arranged above and longitudinally with respect to said conveyor assembly, and a flap compression belt assembly disposed above and to the sides of said conveyor assembly.

24. An apparatus for assembling two-part clip-type article carriers consisting of a base member having a predetermined slotted engagement pattern for mating with a top surface of article groups and a top member having a substantially flat central portion and a plurality of flap portions, comprising:

a) means to input at least one metered, linear stream of article groups;

b) a conveyor assembly constructed and arranged to receive said at least one stream of article groups from said input means and longitudinally translate said groups a predetermined downstream distance at a predetermined rate;

c) a first convertible, adjustable overhead station for processing said base members, said first station including an overhead transfer mechanism constructed and arranged above said conveyor assembly to deposit base members onto a top surface of at least one said article group, and means to bring said base members into mating engagement with said top surface of said at least one article group;

d) a second convertible adjustable overhead station disposed downstream with respect to said first station for processing said top members, said second station including an overhead transfer mechanism constructed and arranged above said conveyor assembly to deposit said top members onto a top surface of at least one said base member; and e) a third convertible adjustable overhead station disposed downstream with respect to said second station, said third station including a top member flap folding means having a cam actuated rotary overhead top panel flap tucking mechanism constructed and arranged above and longitudinally with respect to said conveyor assembly, and a flap compression belt assembly disposed above and to the sides of said conveyor assembly.

25. A convertible, adjustable system for assembling two-part clip-type article carriers for varying article group sizes, and consisting of a base member having a predetermined slotted engagement pattern for mating with a top surface of said article groups and a top member formating engagement with the top surface of at least one said base member, and having a substantially flat central portion and a plurality of flap portions, comprising:

a) means to input at least one metered, linear stream of article groups;

b) a conveyor assembly constructed and arranged to receive said at least one stream of article groups from said input means and longitudinally translate said groups a predetermined downstream distance at a predetermined rate;

c) a first convertible, adjustable overhead station for processing said base members, said first station including an overhead transfer mechanism constructed and arranged above said conveyor assembly to deposit base members onto a top surface of at least one said article group, and means to bring said base members into mating engagement with said top surface of said at least one article group;

d) a second convertible, adjustable overhead station for processing said top members, said second station including an overhead transfer mechanism constructed and arranged above said conveyor assembly to deposit said top members onto a top surface of one said base member;

e) a third convertible, adjustable overhead station disposed downstream with respect to said second station, said third station including a top member flap folding means having a cam actuated rotary overhead top panel flap tucking mechanism constructed and arranged above and longitudinally with respect to said conveyor assembly, and a flap compression belt assembly disposed above and to the sides of said conveyor assembly;

f) a fourth convertible, adjustable overhead station disposed downstream with respect to said third station for processing said top members, said second station including an overhead transfer mechanism constructed and arranged above said conveyor assembly to deposit said top members onto a top surface of at least one said base member; and g) a fifth convertible, adjustable overhead station disposed downstream with respect to said fourth station, said third station including a top member flap folding means having a cam actuated rotary overhead top panel flap tucking mechanism constructed and arranged above and longitudinally with respect to said conveyor assembly, and a flap compression belt assembly disposed above and to the sides of said conveyor assembly.

26. An apparatus for assembling clip-type article carriers of the type having at least one base member mated to the top of an article group and a top member disposed on the base member, comprising:

a) means to input at least one metered, linear stream of article groups;

b) a conveyor assembly constructed and arranged to receive said at least one stream of article groups from said input means and longitudinally translate said groups in a downstream conveyance path;

c) an overhead transfer mechanism constructed and arranged above said conveyor assembly to deposit a clip-type article carrier onto a top surface of at least one said article group;

d) means to bring said clip-type article carrier into mating engagement with said top surface of at least one said article group and e) means to provide one top member in mating engagement over each base member.

27. An apparatus for assembling clip-type article carriers of the type having at least one base member mated to the top of an article group and a top member disposed on the base member, comprising:

a) means to input at least one metered, linear stream of article groups;

b) a conveyor assembly constructed and arranged to receive said at least one stream of article groups from said input means and longitudinally translate said groups in a downstream conveyance path;

c) an overhead transfer mechanism constructed and arranged above said conveyor assembly to deposit a clip-type article carrier onto a top surface of at least one said article group;

d) means to bring said clip-type article carrier into mating engagement with said top surface of at least one said article group and e) means to provide one top member in mating engagement over two base members.

28. A continuous motion packaging machine for applying carton structures having a carton base and a carton top member to the article rims of preselected article groups, comprising:

a) conveyor means having an infeed end for receiving preselected article groups;

b) at least two carton member feeding structures synchronized with said conveyor means and being constructed and arranged to successively place the base and top members on the article groups; and c) means for securing a carton base member to each said preselected article group, first and second glue stations, a carton tucking mechanism, and compression belts disposed adjacent said conveyor means, whereby a carton top member is secured to each carton base member.

29. A continuous motion packaging machine for applying carton structures having a carton base and a carton top member to the article rims of preselected article groups, comprising:

a) conveyor means having an infeed end for receiving preselected article groups;

b) at least two carton member feeding structures synchronized with said conveyor means and being constructed and arranged to successively place the base and top members on the article groups; and c) an inside chime locking wheel and a pair of flexible outside chime locking wheels for securing a carton base member to each said preselected article group, and means to secure a carton top member to each carton base member.

* * * * *